US006745827B2

(12) United States Patent
Lee et al.

(10) Patent No.: US 6,745,827 B2
(45) Date of Patent: Jun. 8, 2004

(54) HEAT EXCHANGER

(75) Inventors: Jun-Kang Lee, Daejeon (KR); Kil-Sang Jang, Daejeon (KR); In-Cheol Han, Daejeon (KR); Chang-Ho Park, Daejeon (KR); Yong-Gwi Ahn, Daejeon (KR); Hwang-Jae Ahn, Daejeon (KR)

(73) Assignee: Halla Climate Control Corporation, Daejeon (KR)

( * ) Notice: Subject to any disclaimer, the term of this patent is extended or adjusted under 35 U.S.C. 154(b) by 0 days.

(21) Appl. No.: 10/255,579

(22) Filed: Sep. 27, 2002

(65) Prior Publication Data

US 2003/0066633 A1 Apr. 10, 2003

(30) Foreign Application Priority Data

| | | |
|---|---|---|
| Sep. 29, 2001 | (KR) | 2001-60973 |
| Sep. 29, 2001 | (KR) | 2001-60974 |
| Sep. 29, 2001 | (KR) | 2001-60975 |
| Oct. 31, 2001 | (KR) | 2001-67614 |

(51) Int. Cl.[7] ..... F28F 9/26
(52) U.S. Cl. ..... 165/144; 165/175
(58) Field of Search ..... 165/144, 174, 165/176, 148, 177, 181, 183, 175; 29/890.053

(56) References Cited

U.S. PATENT DOCUMENTS

| | | | | |
|---|---|---|---|---|
| 2,044,457 A | * | 6/1936 | Young | 165/144 |
| 5,582,239 A | * | 12/1996 | Tsunoda et al. | 165/76 |
| 5,806,587 A | * | 9/1998 | Sasaki et al. | 165/174 |
| 6,155,340 A | * | 12/2000 | Folkedal et al. | 165/175 |
| 6,216,776 B1 | * | 4/2001 | Kobayashi et al. | 165/173 |
| 6,340,055 B1 | * | 1/2002 | Yamauchi et al. | 165/174 |
| 6,581,679 B2 | * | 6/2003 | Fischer et al. | 165/174 |

OTHER PUBLICATIONS

Patent Abstracts of Japan No. 11–304378 dated Nov. 5, 1999.
Patent Abstracts of Japan No. 11–351783 dated Dec. 24, 1999.
Patent Abstracts of Japan No. 2000–081294 dated Mar. 21, 2000.
Patent Abstracts of Japan No. 2001–201276 dated Jul. 27, 2001.
Patent Abstracts of Japan No. 10–206084 dated Aug. 7, 1998.
Patent Abstracts of Japan No. 2001–059687 dated Mar. 6, 2001.

* cited by examiner

*Primary Examiner*—Terrell McKinnon
(74) *Attorney, Agent, or Firm*—Lowe Hauptman Gilman & Berner LLP

(57) ABSTRACT

A heat exchanger uses a refrigerant acting under a high pressure, such as carbon dioxide, as a refrigerant. The heat exchanger includes first and second header pipes arranged a predetermined distance from each other and parallel to each other, each having at least two chambers independently sectioned by a partition wall, a plurality of tubes for separately connecting the chambers of the first and second header pipes, facing each other, wherein the tubes are divided into at least two tube groups, each having a single refrigerant path, a refrigerant inlet pipe formed at the chamber disposed at one end portion of the first header pipe, through which the refrigerant is supplied, a plurality of return holes formed in the partition wall to connect two chambers adjacent to each other, through which the refrigerant sequentially flows the tube groups, and a refrigerant outlet pipe formed at the chamber of one of the first and second header pipes connected to a final tube group of the tube groups along the flow of the refrigerant, through which the refrigerant is exhausted.

26 Claims, 26 Drawing Sheets

HEAT EXCHANGER

BACKGROUND OF THE INVENTION

1. Field of the Invention

The present invention relates to a heat exchanger, and more particularly, to a heat exchanger using carbon dioxide as a refrigerant.

2. Description of the Related Art

In general, a heat exchanger is an apparatus for exchanging heat by transferring heat of a fluid at a high temperature to a fluid at a low temperature through a wall surface. A freon-based refrigerant has mainly been used as a refrigerant of an air conditioning system having a heat exchanger thus far. However, as the freon-based refrigerant is recognized as a major factor of global warming, the use thereof is gradually restricted. Under the above circumferences, studies about carbon dioxide as a next generation refrigerant to replace the present freon-based refrigerant is actively being developed.

The carbon dioxide is regarded as an eco-friendly refrigerant because the global warming potential (GWP) thereof is just about 1/1300 of R134a that is a typical freon-based refrigerant. In addition, the carbon dioxide has the following merits.

The carbon, dioxide refrigerant has a superior volumetric efficiency because an operational compression ratio is low, and a smaller difference of temperature between air that flows in and the refrigerant out of a heat exchanger than that of the existing refrigerant. Since heat transferring performance is excellent, the efficiency of cooling cycle can be improved. When the temperature of the outside air is as low as in the winter time, since heat can be extracted from the outside air by only a small difference in temperature, the possibility of applying the carbon dioxide refrigerant to a heat pump system is very high.

Also, since the volumetric cooling capability (latent heat of vaporization×gas density) of carbon dioxide is 7 or 8 times of R134a that is the existing refrigerant, the volume size of a compressor can be greatly reduced. Since the surface tension thereof is low, boiling heat transfer is superior. Since the specific heat at constant pressure is great and a fluid viscosity is low, a heat transfer performance is superior. Thus, the carbon dioxide refrigerant has superior thermodynamic features as a refrigerant.

Also, in view of the cooling cycle, since the operational pressure is very high such that it is 10 times high at an evaporator side and 6–8 times high at a gas cooler (an existing condenser) side compared to the conventional refrigerant, a loss due to a pressure drop in the refrigerant inside the heat exchanger is relatively low compared to the existing refrigerant, so that a micro channel heat exchange tube exhibiting superior heat transfer performance with great pressure drop can be used.

However, since the cooling cycle of carbon dioxide is a transcritical pressure cycle, not only a vaporization pressure but also a gas-cooling pressure is high by 6–8 times compared to the existing cycle. Thus, in order to use carbon dioxide as a refrigerant, evaporator and condenser presently being used should be redesigned to endure such a high pressure.

That is, a laminate type evaporator among the conventional evaporators for cars cannot use carbon dioxide as a refrigerant because it cannot endure a high pressure. A parallel flow type condenser among the conventional condensers for cars needs to be redesigned so that it can be used as a heat exchanger using carbon dioxide as a refrigerant.

Furthermore, the parallel flow type condenser is of a single slab type designed to have one tube row and adopts a multi-pass method of a single slab in which the flow path of the refrigerant is formed in a multi-pass form by adding a plurality of baffles to improve performance. The multi-pass method exhibits a superior distribution of the refrigerant inside the heat exchanger. However, when the refrigerant is in gas cooling, the temperature of the carbon dioxide refrigerant continuously decreases without a condensing process inside the heat exchanger. Accordingly, the deviation of temperature in the whole heat exchanger becomes serious, so that a self heat flow along the surface of the heat exchanger is generated. This flow of heat prevents heat exchanging between the refrigerant and the air coming from the outside and consequently heat transfer performance is deteriorated.

In the meantime, a multi-slab method in which a plurality of tube rows are arranged through which the refrigerant passes to perform heat exchanging, unlike the multi-pass method, can block the heat flow on the multi-pass method, so that it is effective than the multi-pass method using carbon dioxide as a refrigerant.

However, in the heat exchanger in the multi-slap method, pipes to connect each slab should be installed, which is a weak structure to a high pressure. Also, the distribution of the refrigerant in the heat exchanger may be slightly lowered compared to the multi-pass method.

Conventionally, a serpentine type heat exchanger having an increased thickness has been used as a heat exchanger to endure a high operational pressure without considering a feature of the carbon oxide refrigerant. However, such a serpentine heat exchanger exhibits a great pressure drop and an irregular distribution of the refrigerant in the tubes, so that heat transfer performance is deteriorated while the manufacturing cost increases.

Also, in a heat exchanger used as a gas cooler having the same function as a condenser, the temperature of the refrigerant in the heat exchanger decreases due to the heat transfer with the outside air so that the specific volume of the carbon dioxide refrigerant decreases. In the case of the carbon dioxide refrigerant, the difference in specific volume at a heat exchanger is very great, so that the specific volume of carbon dioxide in a refrigerant inlet having a temperature of about 110° or more is approximately three times greater than the specific volume of carbon dioxide in a refrigerant outlet having a temperature of about 50°.

In the heat exchanger using carbon dioxide as a refrigerant showing a great difference in specific volume according to the temperature, maintaining a constant width of a radiating tube is ineffective in view of miniaturization in weight and size of a heat exchanger and a cost for producing parts increases.

In the meantime, in the heat exchanger in the multi-slab method, since independent refrigerant paths of header tanks of the heat exchanger should be connected separately, each path is connected by additional tubes. Thus, to manufacture a heat exchanger having additional tubes requires a lot of work steps to assemble the heat exchanger.

Japanese Patent Publication No. hei 10-206084 discloses a general configuration of a serpentine heat exchanger. The serpentine heat exchanger has a superior structure but may be damaged when the refrigerant acting at a high pressure such as carbon dioxide is used.

Japanese Patent Publication Nos. 2001-201276 and 2001-59687 disclose heat exchangers having an improved pressure resistance feature of a header pipe. These heat exchangers are not far from the serpentine heat exchanger and is limited to be used as the heat exchanger for carbon dioxide.

In addition, Japanese Patent Publication No. hei 11-304378 discloses a heat exchanger for cars in which a radiator and a condenser are integrally formed. However, such a structure is difficult to be adopted, as is, in the heat exchanger for carbon dioxide.

Also, Japanese Patent Publication No. hei 11-351783 discloses a heat exchanger in which an inner post member is further formed at an inner wall of each of header tanks so that a space formed by the inner post members is circular. However, the heat exchanger in which a single tube is connected to two or more spaces formed by the inner post members basically adopts a multi-pass method, which is not appropriate for the heat exchanger for carbon dioxide.

Japanese Patent Publication No. 2000-81294 discloses a heat exchanger by improving the above heat exchangers, in which a single tube is connected to two spaces formed by the inner post members. Since this heat exchanger has a structure in which the refrigerant coming through the tubes are distributed and enter in the two inner spaces, the inner post members can act as a resistance factor to a refrigerant at a high pressure which is exhausted through the tubes.

SUMMARY OF THE INVENTION

To solve the above-described problems, it is the first object of the present invention to provide a heat exchanger using a refrigerant, such as carbon dioxide, acting under a high pressure as a heat exchange medium.

It is the second object of the present invention to provide a heat exchanger which can cut the flow of heat in the heat exchanger, in a heat exchanger using a fluid capable of generating flow of heat as the temperature of the fluid continuously decreases in the heat transfer, as a refrigerant, and exhibit a superior pressure resistance feature.

It is the third object of the present invention to provide a heat exchanger in which the distribution of a refrigerant is uniformly formed.

It is the fourth object of the present invention to provide a heat exchanger having a structure in which the refrigerant is smoothly connected in the header pipe.

It is the fifth object of the present invention to provide a heat exchanger having a header pipe which can be adopted in a multi-slab type heat exchanger and can adopt a multi-pass method in the multi-slab type heat exchanger.

It is the sixth object of the present invention to provide a heat exchanger whose weight and size can be reduced when a fluid, such as carbon dioxide, having a great difference in specific volume according to a temperature is used as a refrigerant.

It is the seventh object of the present invention to provide a heat exchanger which can improve thermal characteristics of the refrigerant and simultaneously can be manufactured without greatly modifying the manufacturing equipments for the existing condenser, in a heat exchanger using a fluid, such as carbon dioxide, acting under a high pressure and exhibiting a superior heat transfer feature, as a refrigerant.

To achieve the above objects, there is provided a heat exchanger comprising first and second header pipes arranged a predetermined distance from each other and parallel to each other, each having at least two chambers independently sectioned by a partition wall, a plurality of tubes for separately connecting the chambers of the first and second header pipes, facing each other, wherein the tubes are divided into at least two tube groups, each having a single refrigerant path, a refrigerant inlet pipe formed at the chamber disposed at one end portion of the first header pipe, through which the refrigerant is supplied, a plurality of return holes formed in the partition wall to connect two chambers adjacent to each other, through which the refrigerant sequentially flows the tube groups, and a refrigerant outlet pipe formed at the chamber of one of the first and second header pipes connected to a final tube group of the tube groups along the flow of the refrigerant, through which the refrigerant is exhausted.

It is preferred in the present invention that the refrigerant paths of the tube groups adjacent to each other among the tube groups are opposite to each other.

It is preferred in the present invention that the tube group connected to the chamber where the refrigerant outlet pipe is formed is arranged at an upstream of the flow of air supplied into the heat exchanger.

It is preferred in the present invention that the tube group is formed of a row of the tubes connecting one of the chambers of the first header pipe and one of the chambers of the second header pipe corresponding thereto.

It is preferred in the present invention that at least a baffle for sectioning each chamber is provided at at least two chambers of each of the first and second header pipes, and the row of the tubes connected to the chamber having the baffle are divided into two tube groups with respect to each baffle.

It is preferred in the present invention that the refrigerant inlet pipe and the refrigerant outlet pipe are formed in the same chamber, and that the refrigerant inlet pipe and the refrigerant outlet pipe are formed in different chambers of the first header pipe.

It is preferred in the present invention that the chambers of the first and second header pipes are roughly circular.

It is preferred in the present invention that a thickness of a horizontal section of the partition wall is thicker than a thickness of a horizontal section of the remaining portion of the first and second header pipes.

It is preferred in the present invention that a thickness of a horizontal section of the partition wall is 1.5 through 2.5 times greater than a thickness of a horizontal section of the other portion.

It is preferred in the present invention that each of the return holes is roughly circular, and that each of the return holes is roughly rectangular.

It is preferred in the present invention that each of the first and second header pipes is formed by brazing a header which is extruded or press-processed and has a plurality of slits into which the tubes are inserted and a tank which is extruded or press-processed.

It is preferred in the present invention that the partition wall is integrally formed at at least one of the header and the tank of each of the first and second header pipes.

It is preferred in the present invention that the first and second header pipes comprise at least one caulking coupling portion, and that the caulking coupling portion is provided between at least one of the header and the tank and the partition wall.

It is preferred in the present invention that the partition wall is formed of additional member and brazed to an inner wall of each of the first and second header pipes.

It is preferred in the present invention that thicknesses of the tubes are formed different from one tube group to the other tube group, according to a temperature of the refrigerant flowing through each tube group.

It is preferred in the present invention that the width of each tube of the tube group through which a refrigerant of a high temperature flows is formed to be greater than the width of tube of the tube group through which a refrigerant of a low temperature flows.

It is preferred in the present invention that, when a width of each tube of the tube group through which a refrigerant of a high temperature flows is X and a width of each tube of the tube group through which a refrigerant of a low temperature flows is Y, the X and Y satisfy a relationship that $0.5X \leqq Y < X$.

It is preferred in the present invention that each of the tubes comprises a plurality of micro channel tubes, and when a hydraulic diameter of each micro channel tube of the tube group through which a refrigerant of high temperature flows is x and a hydraulic diameter of each micro channel tube of the tube group through which a refrigerant of low temperature flows is y, the x and y satisfy a relationship that $0.5\Sigma x \leqq \Sigma y < \Sigma x$.

To achieve the above objects, there is provided a heat exchanger comprising, first and second header pipes arranged to be separated a predetermined distance from each other and parallel to each other, a plurality of tubes for connecting the first and second header pipes, wherein the tubes neighboring with each other are connected by a bridge in which a plurality of through holes are formed, a refrigerant inlet pipe formed at one end portion of the first header pipe and through which a refrigerant is supplied to the first header pipe, and a refrigerant outlet pipe formed at one of the first and second header pipes and through which the refrigerant is exhausted.

It is preferred in the present invention that the bridge is formed to be thinner than the tube.

It is preferred in the present invention that each of the first and second header pipes has at least two chambers separated by a partition wall, and the tubes separately connect the chambers of the first and second header pipes facing each other.

It is preferred in the present invention that each of the chambers is divided into at least two spaces extended along a lengthwise direction of each header pipe, and the respective tubes are connected to the spaces of each chamber.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Figure 1:
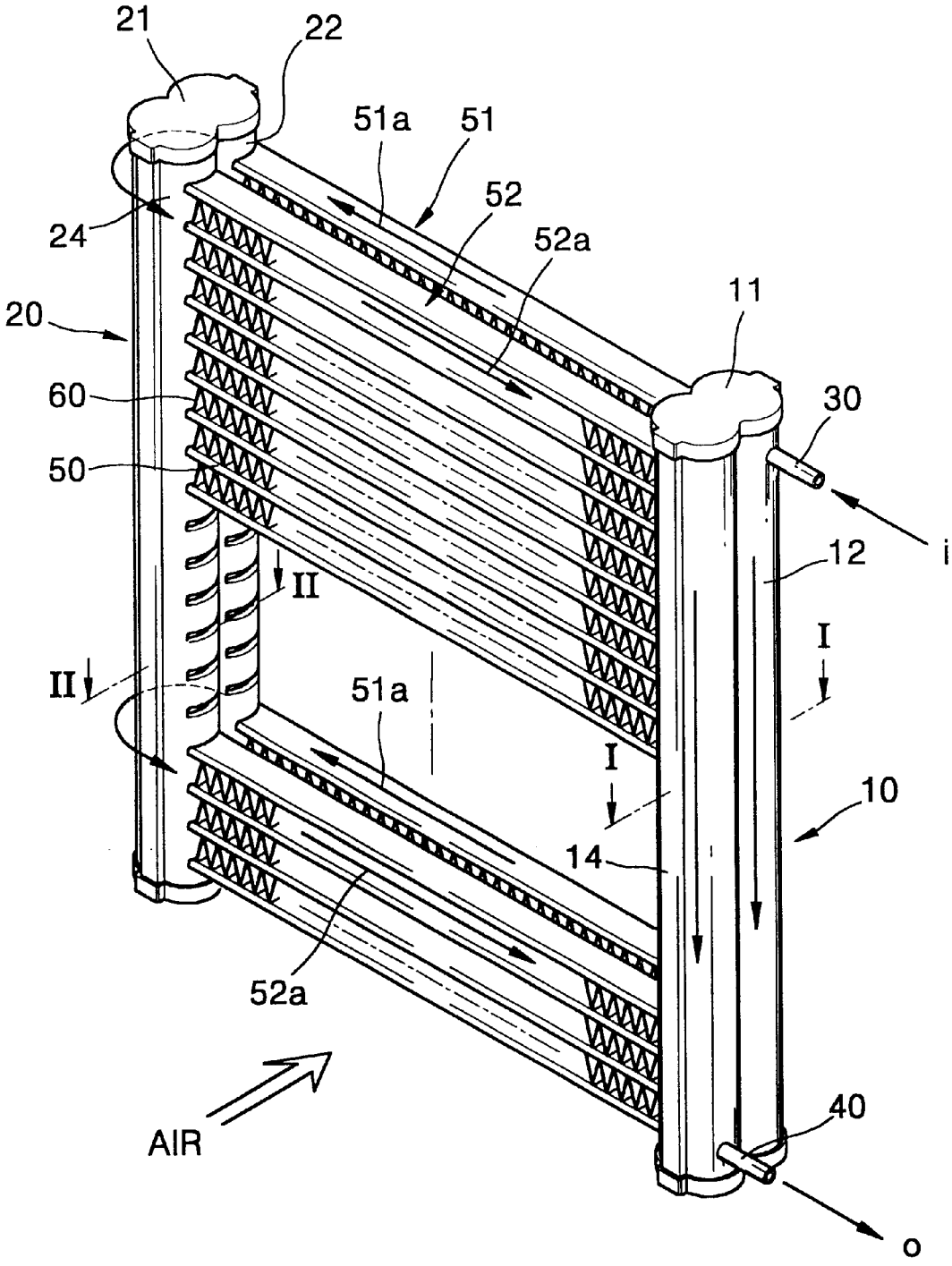
FIG. 1 is a perspective view illustrating a heat exchanger according to a preferred embodiment of the present invention.

Referring to FIG. 1, a heat exchanger according to a preferred embodiment of the present invention includes a first header pipe 10 having a first chamber 12 and a third chamber 14 which are separated by a partition wall, and a second header pipe 20 having a second chamber 22 and a fourth chamber 24 which are separated by a partition wall. The upper and lower ends of each of the header pipes 10 and 20 are sealed by caps 11 and 21 and the head pipes 10 and 20 are separated a predetermined distance from each other to be parallel to each other.

A plurality of tubes 50 connecting the respective chambers 12, 14, 22, and 24 and through which refrigerant flows are installed between the first and second header pipes 10 and 20. The tubes 50 connect the first chamber 12 of the first header pipe 10 and the second chamber 22 of the second header pipe 20, and the third chamber 14 of the first header pipe 10 and the fourth chamber 24 of the second header pipe 20, respectively. A radiation fin 60 is installed between the tubes 50 vertically arranged so that the refrigerant flowing in the tubes 50 smoothly exchanges heat with air that is a second heat exchanger medium.

A refrigerant inlet pipe 30 is installed at the upper portion of the first chamber 12 of the first header pipe 10 and a refrigerant outlet pipe 40 is installed at the lower portion of the third chamber 14 of the first header pipe 10. A plurality of return holes for connecting the second chamber 22 and the fourth chamber 24 as described later are formed in a partition wall separating the second chamber 22 and the fourth chamber 24 of the second header pipe 20 so that the refrigerant coming into each chamber can be returned.

In the heat exchanger having the above structure, the tubes 50 are divided into at least two tube groups, each tube group being formed of tubes having one refrigerant path along which a refrigerant flows at the same time and in the same direction. According to a preferred embodiment of the present invention, the tube group includes a row of tubes connecting one chamber of the first header pipe 10 and a corresponding chamber of the second header pipe 20, and a heat transfer with the tube groups can be provided as a multi-slab heat exchanger.

According to a preferred embodiment of the present invention shown in FIG. 1, the tubes 50 are divided into a first tube group 51 and a second tube group 52. As can be seen from FIG. 1, the first tube group 51 is formed of a row of tubes connecting the first chamber 12 of the first header pipe 10 and the second chamber 22 of the second header pipe 20, while the second tube group 52 is formed of a row of tubes connecting the third chamber 14 of the first header pipe 10 and the fourth chamber 24 of the second header pipe 20. Here, the first tube group 51 has a first refrigerant path 51*a* from the first chamber 12 to the second chamber 22, while the second tube group 52 has a second refrigerant path 52*a* from the fourth chamber 24 to the third chamber 14. Thus, the refrigerant supplied through the refrigerant inlet pipe 30 attached to the first chamber 12 passes through the first chamber 12 and performs heat transfer while passing along the first refrigerant path 51*a* of the first tube group 51 and arrives at the second chamber 22. Then, the refrigerant is returned from the second chamber 22 to the fourth chamber 24. The refrigerant performs heat transfer as it passes along the second refrigerant path 52*a* of the second tube group 52, and then, arrives at the third chamber 14 and is exhausted through the refrigerant outlet pipe 40. In the present invention, the first tube group 51 and the second tube group 52 adjacent to each other have the refrigerant paths 51*a* and 52*a* in the opposite directions so that the efficiency of heat transfer can further be improved.

Here, as can be seen from FIG. 1, since the second tube group 52 connected to the third chamber 14 where the refrigerant outlet pipe 40 is formed is arranged at the upstream of the flow of air coming from the outside, the flow of the refrigerant is counter-flow to the flow of the air, so that the efficiency of heat transfer is improved as a whole. This structure will be applied to all of preferred embodiments according to the present invention to be described later.

Figure 2:
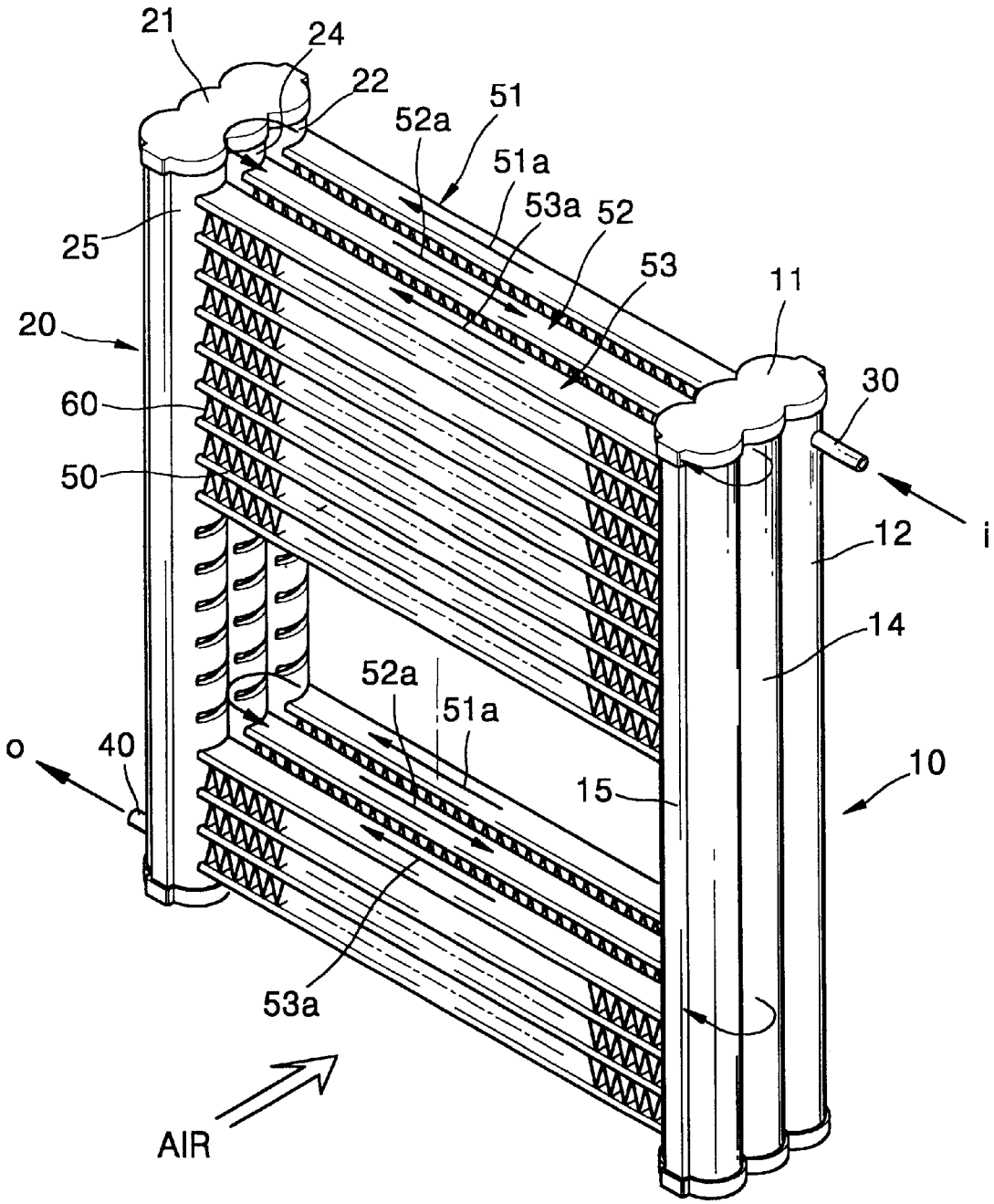
FIG. 2 is a perspective view illustrating a heat exchanger according to another preferred embodiment of the present invention.

FIG. 2 shows a heat exchanger according to another preferred embodiment of the present invention in which a tube group formed of a row of tubes is additionally provided. Referring to FIG. 2, the first and second header pipes 10 and 20 further include fifth and sixth chambers 15 and 25, respectively. The fifth and sixth chambers 15 and 25 are connected by the tubes 50. Here, the row of tubes connecting the fifth and sixth chambers 15 and 25 forms a third tube group 53. The third tube group 53 has a third refrigerant path 53*a* from the fifth chamber 15 to the sixth chamber 25. Thus, the incoming refrigerant i returns after passing through the first tube group 51, returns after passing through the second tube group 52, and is exhausted as an outgoing refrigerant o after passing through the third tube group 53. Here, the refrigerant outlet pipe 40 is installed at the sixth chamber 25 connected to the third tube group 53 that is the final tube group along the flow of the refrigerant. Not only the second and fourth chambers 22 and 24 of the second header pipe 20, but also the third and fifth chambers 14 and 15 of the first header pipe 10, are connected. The third and fifth chambers 14 and 15 of the first header pipe 10 are connected by a plurality of return holes formed in a partition wall separating the third chamber 14 and the fifth chamber 15. As in the above-described preferred embodiment, the first tube group 51, the second tube group 52, and the third tube group 53 adjacent to one another have the refrigerant paths 51*a*, 52*a*, and 53*a* in the opposite directions so that the efficiency of heat transfer is further improved. Also, since the third tube group 53 connected to the fifth chamber 15 where the refrigerant outlet pipe 40 is formed is arranged at the upstream of the flow of air coming from the outside, the flow of the refrigerant is counter-flow to the flow of the air, so that the efficiency of heat transfer is improved as a whole.

It is obvious that the above structure can be applied to a heat exchanger including more number of chambers so that it has a plurality of tube groups.

Figure 3A:
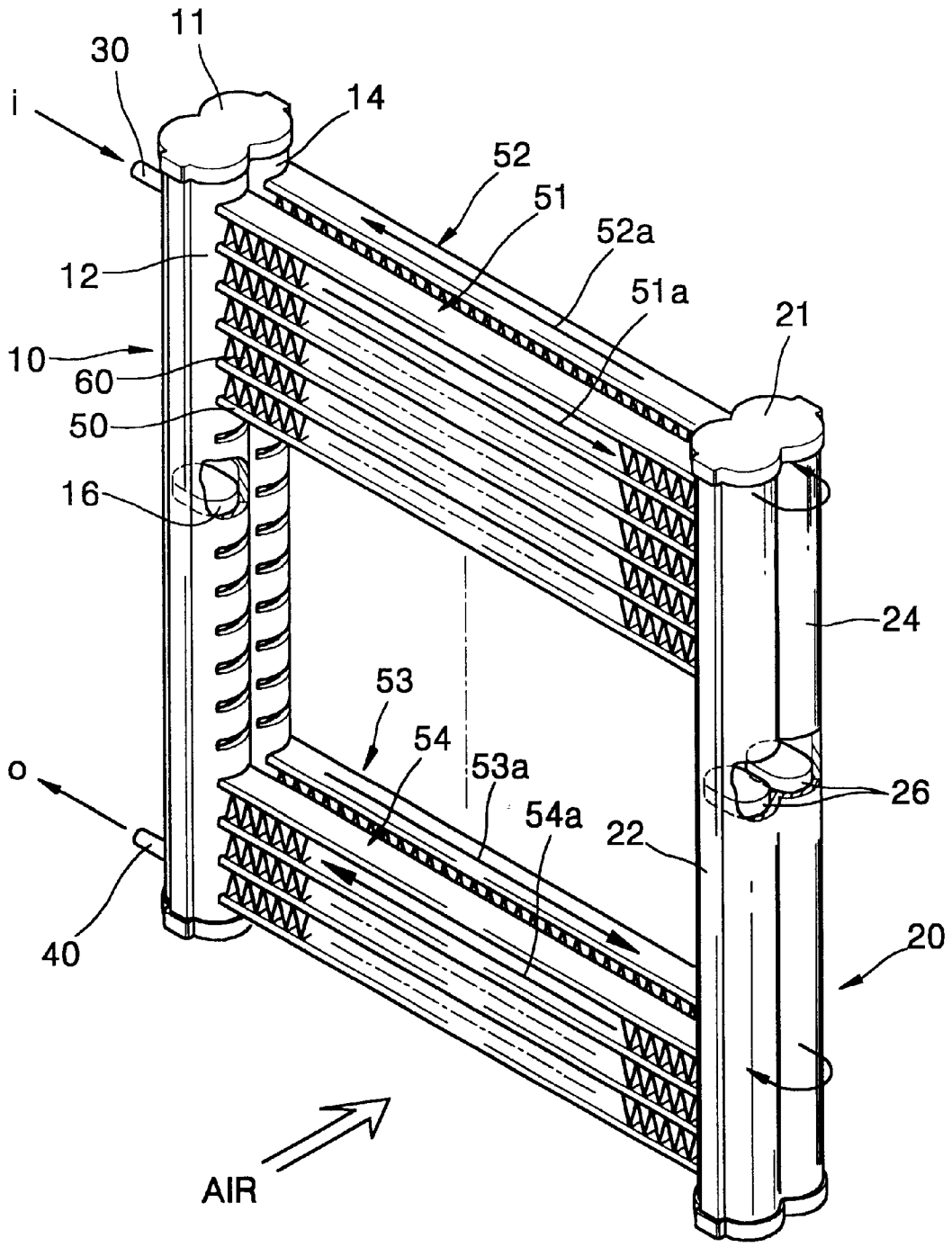
FIGS. 3A and 3B are heat exchangers having different baffle structures according to yet another preferred embodiment of the present invention.
Figure 3B:
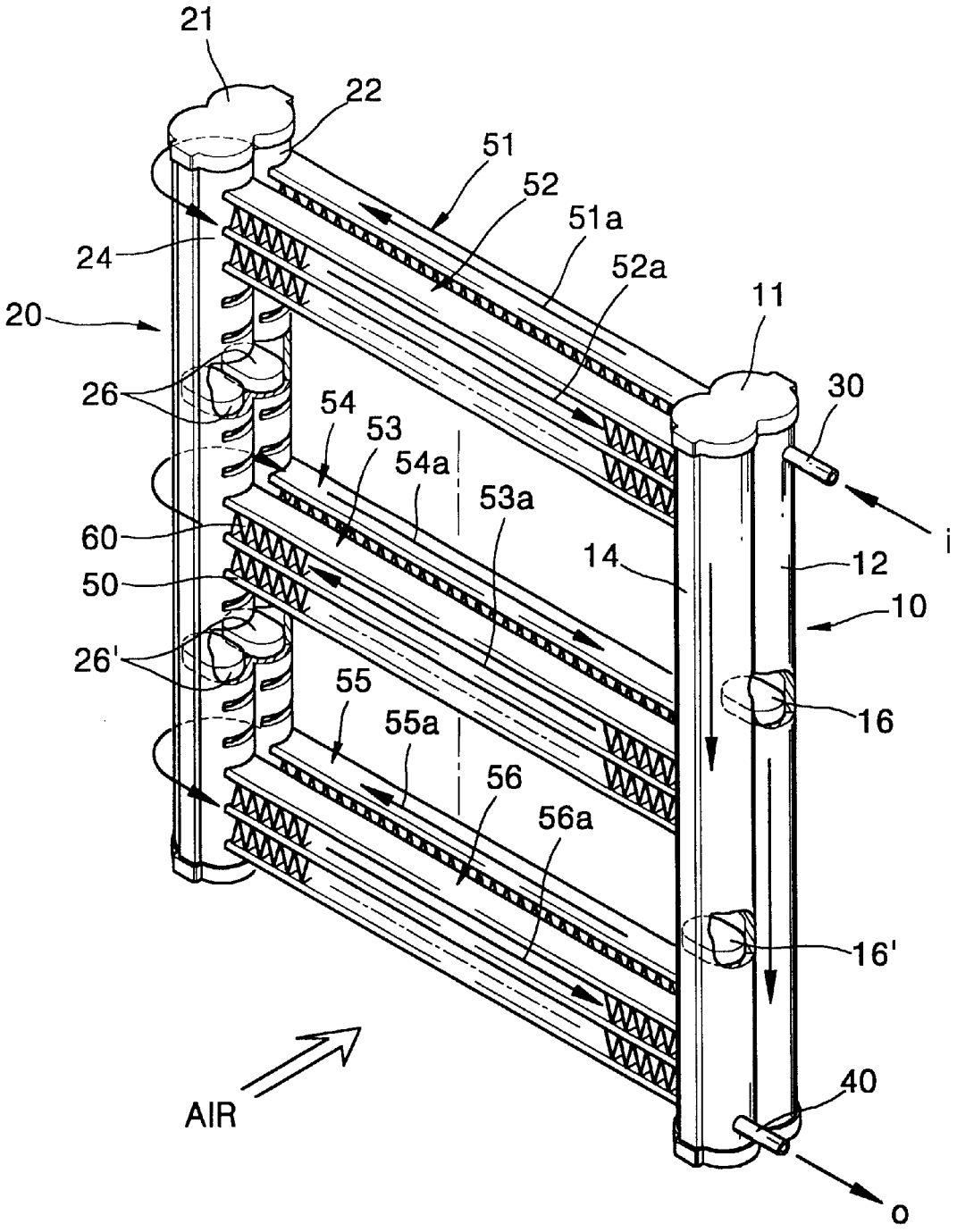

FIGS. 3A and 3B show a heat exchanger according to yet another preferred embodiment of the present invention to improve the distribution of a refrigerant which may be inferior in the above-described multi-slab type heat exchanger. That is, a baffle is added in each chamber of the header pipes of the heat exchanger so that row of tubes connected to the chamber having the baffle can be divided into two tube groups with respect to the baffle. The preferred embodiments of the present invention as shown in FIGS. 3A and 3B have structures in which baffles are added in the heat exchanger having two tube groups as shown in FIG. 1. It is obvious that the structure in which a baffle is added can be adopted in the preferred embodiment of FIG. 2.

The heat exchanger of FIG. 3A is formed by installing baffles 16 and 26 at the chambers of the first and second header pipes 10 and 20 of the heat exchanger shown in FIG. 1. According to the present preferred embodiment of the present invention, the baffle 16 is installed only in the first chamber 12 of the first header pipe 10 while the baffle 26 is installed in both of the second and fourth chambers 22 and 24 of the second header pipe 20. Here, the baffle 26 installed at the second header pipe 20 are installed to simultaneously section the second chamber 22 and the fourth chamber 24. The returning path of the refrigerant at the second header pipe 20 may be two due to the baffle installed in the second header pipe 20.

When the baffles 16 and 26 are installed, each row of the tubes 50 forms two tube groups respectively. The row of the tubes connecting the first chamber 12 of the first header pipe 10 and the second chamber 22 of the second header pipe 20 are divided into an upper first tube group 51 and a lower fourth tube group 54 with respect to the baffle 16 installed in the first chamber 12 and the baffle 26 installed in the second chamber 22. The row of the tubes connecting the third chamber 14 of the first header pipe 10 and the fourth chamber 24 of the second header pipe 20 are divided into an upper second tube group 52 and a lower third tube group 53 with respect to the baffle 26 installed in the fourth chamber 24. Here, the first, second, third, and fourth tube groups 51, 52, 53, and 54 have the first, second, third, and fourth refrigerant paths 51*a*, 52*a*, 53*a*, and 54*a*.

In the heat exchanger, the refrigerant supplied through the refrigerant inlet pipe 30 installed at the first chamber 12 of the first header pipe 10 is prevented from flowing downward by the baffle 16 installed in the first chamber 12, and flows through the first tube group 51, forming the first refrigerant path 51*a*, in the second chamber 22 of the second header pipe 20. The refrigerant is returned to the fourth chamber 24 in the second header pipe 20. While being prevented from flowing downward by the baffle 26 installed in both the second and fourth chambers 22 and 24 of the second header pipe 20, the refrigerant flows through the second tube group 52, forming the second refrigerant path 52*a*, into the third chamber 14 of the first header pipe 10. The refrigerant flowing in the third chamber 14 flows downward to the lowest portion of the third chamber 14 where no baffle is installed. Here, the refrigerant flows through the third tube group 53, forming the third refrigerant path 53*a*, toward the fourth chamber 24 of the second header pipe 20. The refrigerant flowing into the lower portion of the fourth chamber 24 is returned to the second chamber 22 through the return holes and flows through the fourth tube group 54, forming the fourth refrigerant path 54*a*, into the first chamber 12. Finally, the refrigerant is exhausted to the outside through the refrigerant outlet pipe 40 coupled to the first chamber 12.

In the heat exchanger having the above structure, the refrigerant outlet pipe 40 is installed at the same chamber where the refrigerant inlet pipe 30 is installed, as shown in FIG. 3A.

In the above-described preferred embodiment, the first tube group 51, the second tube group 52, the third tube group 53, and the fourth tube group 54 installed adjacent to one another have the refrigerant paths 51*a*, 52*a*, 53*a*, and 54*a* in the opposite directions to one another so that the efficiency of heat transfer is further improved. Since the fourth tube group 54 connected to the first chamber 12 where the refrigerant outlet pipe 40 is formed is arranged at the upstream of the flow of air coming from the outside, the flow of the refrigerant is counter-flow to the flow of the air, so that the efficiency of heat transfer is improved as a whole.

Next, in the heat exchanger shown in FIG. 3B, two pairs of baffles 26 and 26' are installed in the second header pipe 20 so that three refrigerant return paths are formed in the second header pipe 20. Here, baffles 16 and 16' are installed in the first and third chambers 12 and 14 of the first header pipe 10, respectively. The baffles 16 and 16' are installed at the same height where the baffles 26 and 26' are installed in the second header pipe 20. As described above, the baffles 26 and 26' installed in the second header pipe 20 simultaneously section the second and fourth chambers 22*a* and 24.

Each row of the tubes 50 forms three tube groups by the baffles 16, 16', 26, and 26' respectively. The tube row connecting the first chamber 12 of the first header pipe 10 and the second chamber 22 of the second header pipe 20 is divided into a first tube group 51 at the upper side thereof, a fourth tube group 54 at the middle portion thereof, and a fifth tube group 55 at the lower portion thereof with respect to the baffle 16 installed in the first chamber 12 and the baffles 26 and 26' formed in the second chamber 22. The tube row connecting the third chamber 14 of the first header pipe 10 and the fourth chamber 24 of the second header pipe 20 is divided into a second tube group 52 at the upper portion thereof, a third tube group 53 at the middle portion thereof, and a sixth tube group 56 at the lower portion thereof with respect to the baffle 16' installed in the third chamber 14 and the baffles 26 and 26' formed in the fourth chamber 24. Here, the first, second, third, fourth, fifth, and sixth tube groups 51, 52, 53, 54, 55, and 56 have the first, second, third, fourth, fifth, and sixth refrigerant paths 51*a*, 52*a*, 53*a*, 54*a*, 55*a*, and 56*a*, respectively.

In the heat exchanger according to FIG. 3B, the refrigerant supplied through the refrigerant inlet pipe 30 installed at the first chamber 12 of the first header pipe 10 is prevented from flowing to the middle portion by the baffle 16 formed in the first chamber 12 and flows through the first tube group 51, forming the first refrigerant path 51*a*, toward the second chamber 22 of the second header pipe 20. The refrigerant is returned to the fourth chamber 24 and the refrigerant coming in the fourth chamber 24 is prevented from flowing toward the middle portion by the baffle 26 formed in the second and fourth chambers 22 and 24 of the second header pipe 20 and flows through the second tube group 52, forming the second refrigerant path 52*a*, toward the third chamber 14 of the first header pipe 10. The refrigerant coming in the third chamber 14 is prevented from flowing downward by the baffle 16' sectioning the middle portion and the lower portion of the third chamber 14 and flows through the third tube group 53, forming the third refrigerant path 53*a*, toward the fourth chamber 24 of the second header pipe 20. The refrigerant coming in the middle portion of the fourth chamber 24 is returned to the second chamber 22 through the return hole and flows through the fourth tube group 54, forming the fourth refrigerant path 54*a*. The refrigerant flows in the first chamber 12 and then downward, and flows through the fifth tube group 55, forming the fifth refrigerant path 55*a*, toward the second chamber 22 of the second header pipe 20. Then, the refrigerant is returned to the fourth chamber 24 and flows through the sixth tube group 56, forming the sixth refrigerant path 56*a*, toward the third chamber 14. Finally, the refrigerant is exhausted through the refrigerant outlet pipe 40 connected to the third chamber 14 to the outside of the hear exchanger.

As shown in FIG. 3B, the refrigerant outlet pipe 40 is installed at the third chamber 14, not at the first chamber 12 where the refrigerant inlet pipe 30 is installed. When the number of refrigerant return paths in the second header pipe is odd, the refrigerant inlet pipe 30 and the refrigerant outlet pipe 40 are attached to different chambers. The first, second, third, fourth, fifth, and sixth tube groups 51, 52, 53, 54, 55, and 56 have the first, second, third, fourth, fifth, and sixth refrigerant paths 51*a*, 52*a*, 53*a*, 54*a*, 55*a*, and 56*a*, respectively, arranged in the opposites directions to one another so that the efficiency of heat transfer can be further improved. Since the sixth tube group 56 connected to the third chamber 14 where the refrigerant outlet pipe 40 is formed is disposed at the upstream of the flow of air coming from the outside, the flow of the refrigerant is counter-flow to the flow of the air, so that the efficiency of heat transfer can be improved as a whole.

Next, the header pipe adopted in the heat exchanger according to preferred embodiments of the present invention will now be described.

Figure 4A:
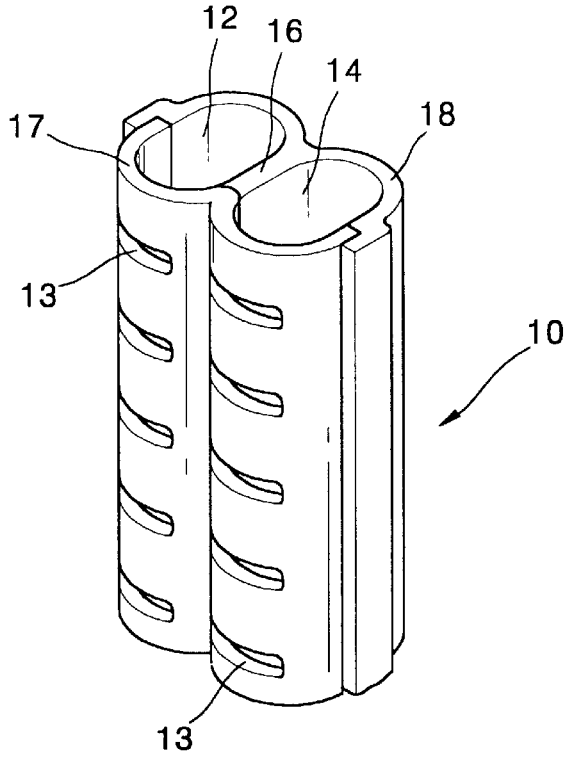
FIG. 4A is a perspective view illustrating a preferred embodiment of the first header pipe of FIG. 1.
Figure 4B:
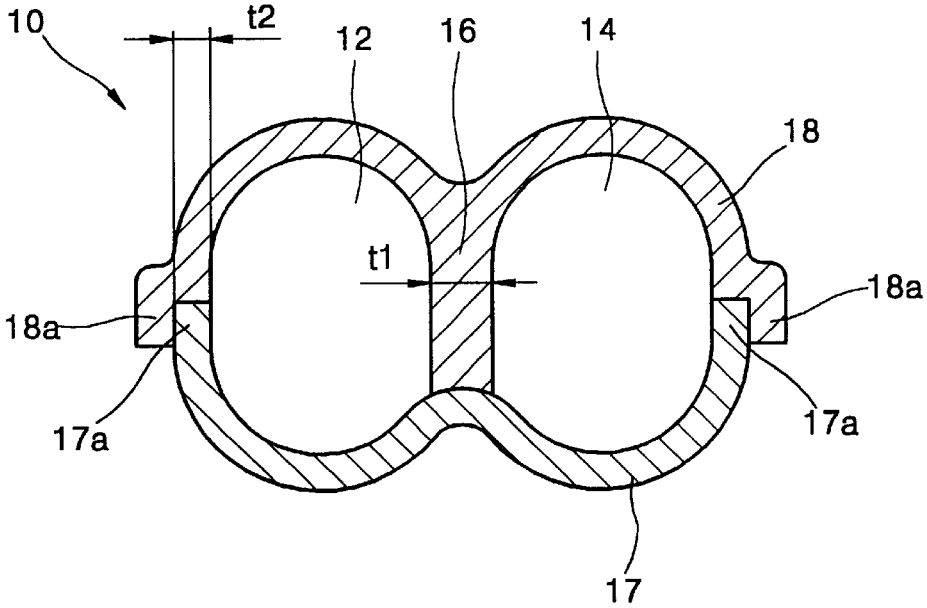
FIG. 4B is a sectional view taken along line I—I of FIG. 1, illustrating the preferred embodiment of the first header pipe of FIG. 1.

FIGS. 4A and 4B show the first header pipe 10 of the heat exchanger according to the preferred embodiment of the present invention shown in FIG. 1. The first header pipe 10 has a header 17 and a tank 18 coupled to each other to form the independent chambers 12 and 14 guiding the flow of the refrigerant according to the length thereof. The second header pipe 20 has the same structure as above. Although the chambers 12, 14, 22, and 24 of the first and second header pipes 10 and 20 may have horizontal sections of any shapes, an approximate circular horizontal section is preferable to endure well a great operational pressure of the carbon dioxide refrigerant. The following description will be based on the first header pipe 10.

The first header pipe 10, as shown in FIG. 4A, is formed of the header 17 where a plurality of slots 13 are formed and the tank 18 coupled to the header 17. Although the header 17 and the tank 18 may be manufactured in any methods, to make the horizontal sections of the chambers 12 and 14 approximately circular, if possible, header 17 is press-processed and the tank 18 is extruded. Accordingly, as shown in FIG. 4B, the header 17 and the tank 18 are preferably brazing-coupled so that an end portion 17*a* of the header 17 is completely accommodated at the inner side of an end portion 18*a* of the tank 18. In the conventional heat exchanger, both the header and tank are press-processed, unlike the present preferred embodiment, and the header and tank are coupled so that the end portion of the tank is accommodated at the inner side of the end portion of the header and the horizontal section of the refrigerant flow path is not a complete circle. In this structure, since the portions of the header and the tank which are coupled to each other do not completely contact, when the carbon dioxide refrigerant having a great operation pressure is used, the coupling portion between the tank and the header does not endure a high pressure and may be broken. However, in the structure of the present preferred embodiment, since the tank is extruded so that the header is formed to closely contact the portion of the tank where the header is accommodated, there hardly is any possibility as above. For example, when both end portions 17*a* of the header are press-processed to be close to a right angle and both end portions 18*a* of the tank where both end portions 17*a* are accommodated are extruded to be close to a right angle. Then, both portions 17*a* and 18*a* are coupled together so that a force of closely contacting further increases. In the present invention, it is obvious that both the header 17 and the tank 18 can be formed by an extrusion process or press process.

In the meantime, as can be seen from FIG. 4A, a plurality of slots 13 are formed in the header 17. Since the slots 13 are separately formed in each of the chambers 12 and 14 of the first header pipe 10, the tubes can be coupled to the slots 13.

Referring to FIG. 4B, a thickness t1 of the horizontal section of the partition wall 16 sectioning the chambers 12 and 14 in the first header pipe 10 is preferably thicker than a thickness t2 of the horizontal section of the remaining portion. Since the pressure of the carbon dioxide refrigerant in the chambers 12 and 14 of the first header pipe 10 affecting the first header pipe 10 are the same in all directions, the partition wall 16 separating a pair of the chambers 12 and 14 to be independently receives a force approximately twice greater than the force the remaining portion receives, so that a possibility of the coupling being damaged is high accordingly. Thus, by forming the thickness of the horizontal section of the partition wall 16 to be greater than the remaining portion to increase the coupling portion, the partition wall 16 can endure a high operational pressure of the carbon dioxide refrigerant equal to the remaining portion. Table 1 shows a burst pressure of the first header pipe 10 with respect to a change in the ratio (t1/t2=x) of the thickness t1 of the partition wall 16 to the thickness t2 of the remaining portion.

TABLE 1

| Ratio of thickness of partition wall (t1/t2 = x) | Burst Pressure (Mpa) |
|---|---|
| 0.5 | 24.5 |
| 1.0 | 31.8 |
| 1.5 | 41.2 |
| 2.0 | 53.5 |
| 2.5 | 69.3 |
| 3.0 | 89.9 |
| 3.5 | 116.6 |
| 4.0 | 151.3 |
| 4.5 | 196.2 |
| 5.0 | 254.5 |

As can be seen from Table 1, the relationship between the ratio (t1/t2=x) of the thickness t1 of the partition wall 16 to the thickness t2 of the remaining portion and the burst pressure Pb can be summarized as the following Equation 1.

$$Pb=18.9\times e^{0.52x} \quad \text{[Equation 1]}$$

Figure 5:
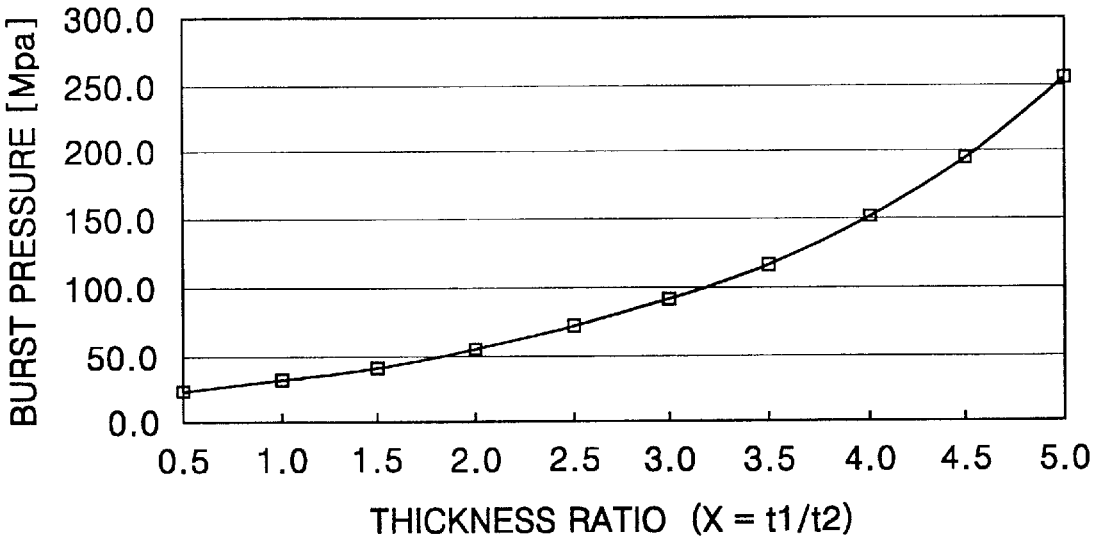
FIG. 5 is a graph showing the relationship between the thickness ratio x and the burst pressure of a partition wall.

As can be seen from Table 1 and FIG. 5, a satisfactory level of a burst pressure can be obtained when the thickness t1 of the partition wall 16 is formed to be 1.5 times or more of the thickness t2 of the remaining portion. Thus, the thickness t1 of the partition wall 16 is preferably set to be 1.5 times or more of the thickness t2 of the remaining portion. When the thickness t1 of the partition wall 16 is excessively increased, unnecessary consumption of material increases. Since the thickness and the entire weight of the heat exchanger can be increased, the thickness t1 of the partition wall 16 is preferably less than 2.5 times of the thickness t2 of the remaining portion. When the thickness t1 of the partition wall is 2.5 times or more greater than the thickness t2 of the remaining portion, burst can be generated at the portion having the thickness of t2.

As described above, it is obvious that the structure of the first header pipe can be identically adopted, as it is, in the second header pipe and in a single header pipe in which two or more chambers are provided.

In the meantime, the header 17 and the tank 18 of the first header pipe 10, as shown in FIGS. 6A through 6D, preferably have the caulking coupling portion C coupled by a caulking coupling. Although not shown in the drawings, it is obvious that the caulking coupling portion is provided in the second header pipe 20. The caulking coupling portion C increases a coupling force between the header 17 and the tank 18, to improve brazing property, so that the first header pipe 10 can well endure the high operational pressure of the carbon dioxide refrigerant.

Figure 6A:
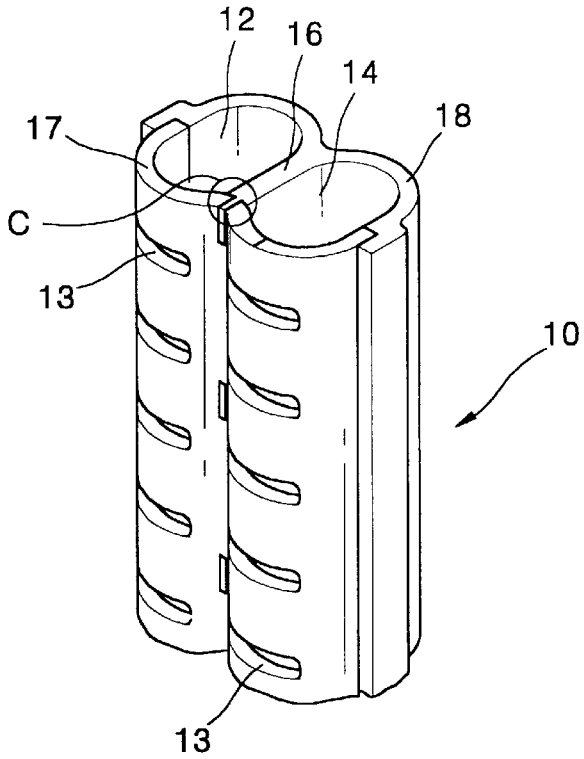
FIGS. 6A through 6D are views illustrating a caulking coupling portion formed in the first header pipe.
Figure 6B:
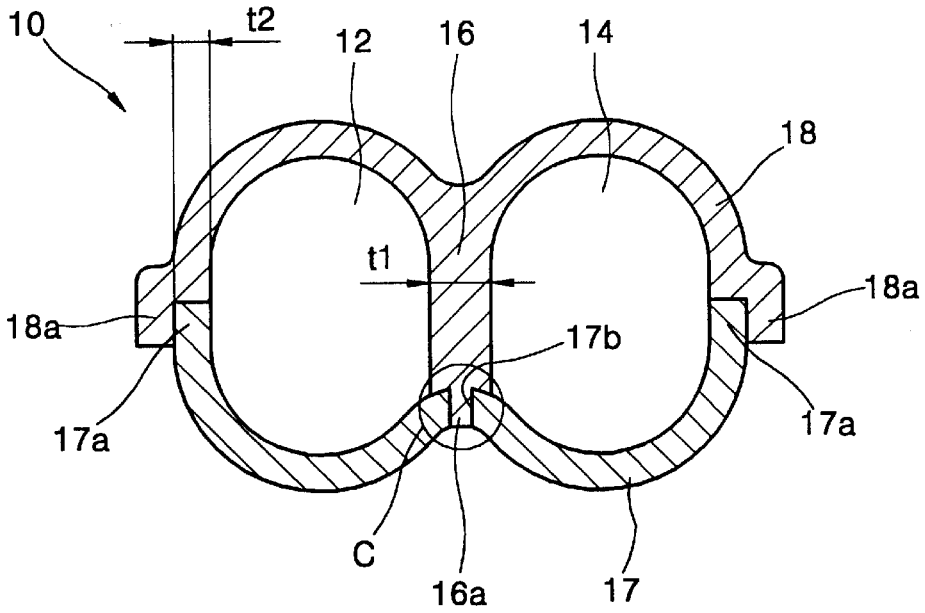
Figure 6C:
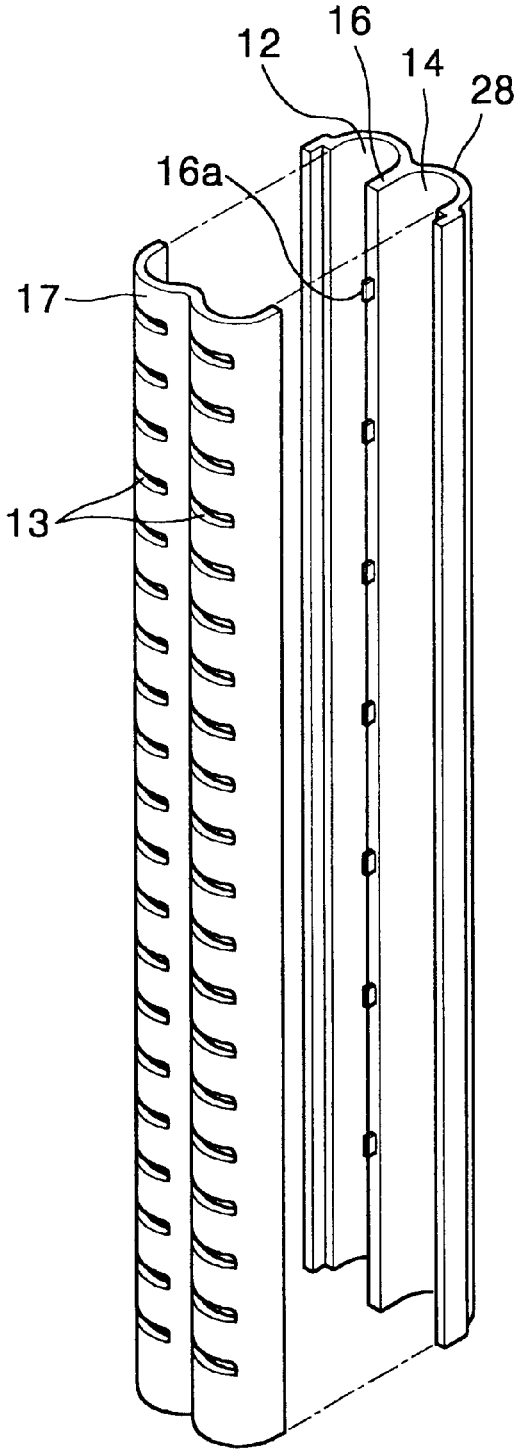
Figure 6D:
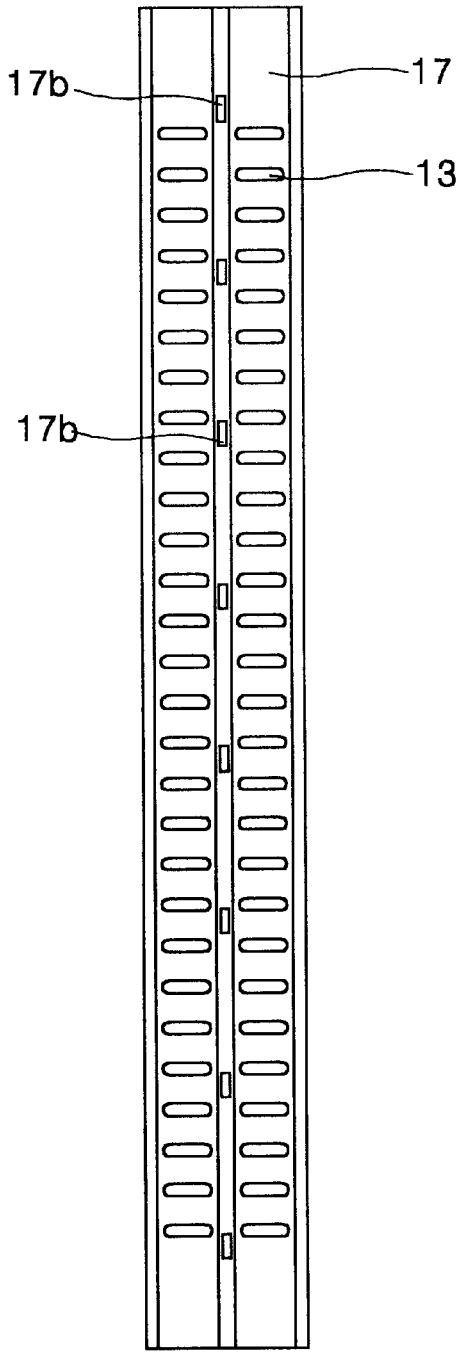

The caulking coupling portion C, as shown in FIGS. 6A through 6D, has a caulking protrusion 16*a* formed at an end portion of the partition wall 16 integrally formed at the tank 18 and a caulking groove 17*b* at the header 17 corresponding to the caulking protrusion 16*a*. The caulking protrusion 16*a*, as shown in FIG. 6C, is formed in multiple numbers to be separated at an interval of a predetermined distance. The caulking groove 17*b*, as shown in FIG. 6D, can be formed as a through-hole so that the caulking protrusion 16*a* is inserted.

Figure 7:
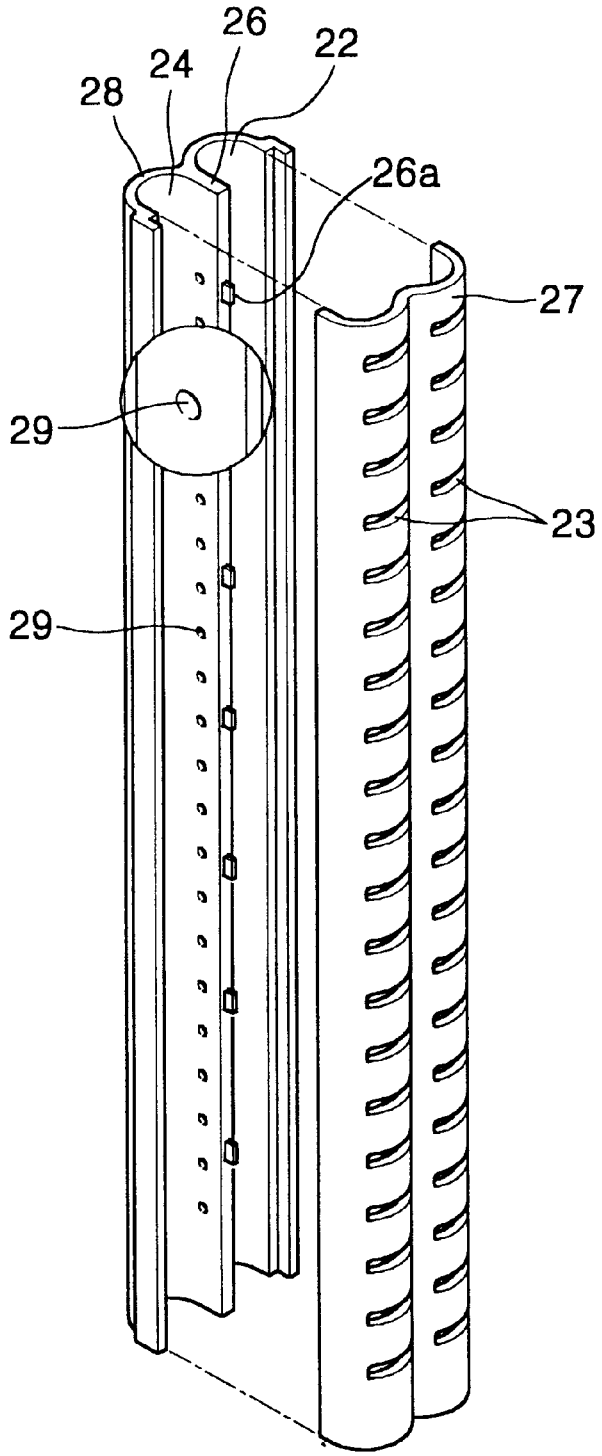
FIG. 7 is an exploded perspective view illustrating part of the second head pipe.
Figure 8:
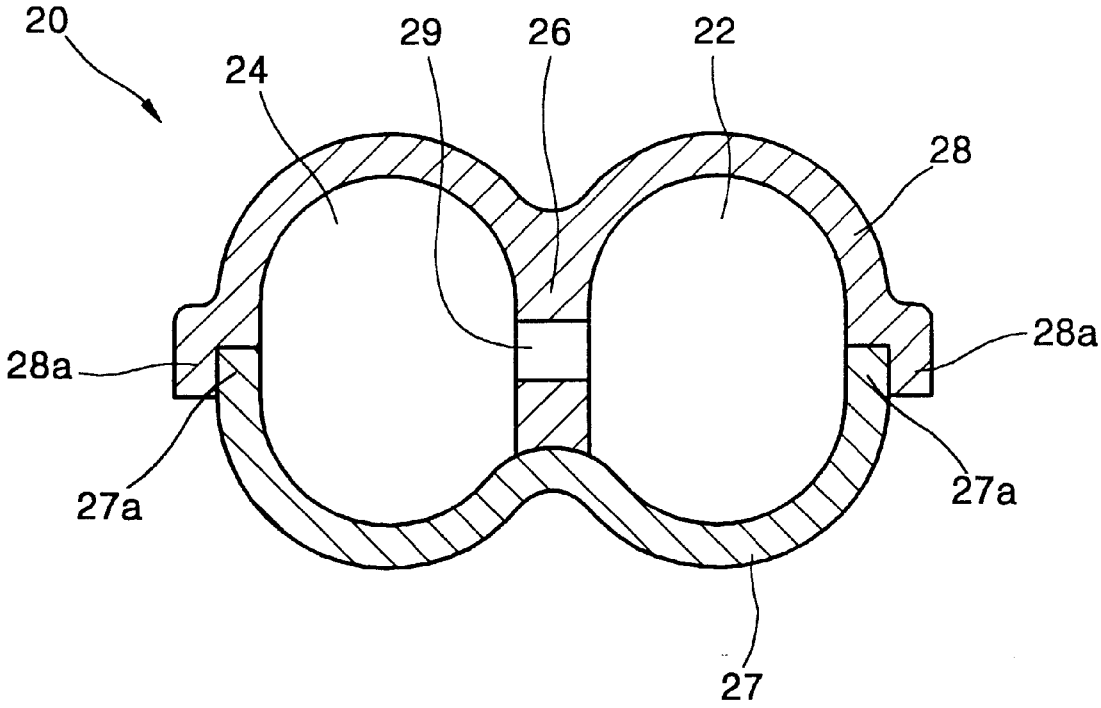
FIG. 8 is a sectional view, taken along line II—II of FIG. 1, illustrating a preferred embodiment of the second header pipe.
Figure 9:
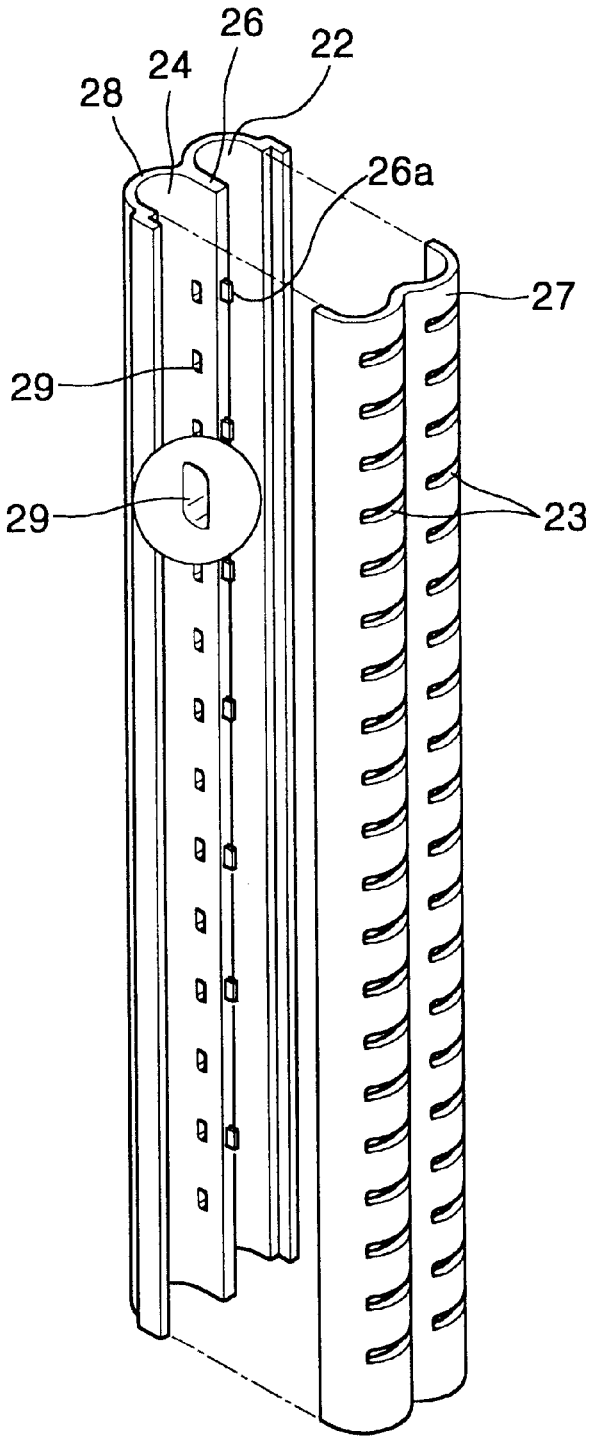
FIGS. 9 through 12 are exploded perspective views illustrating different preferred embodiments of a return hole of the second head pipe.
Figure 10:
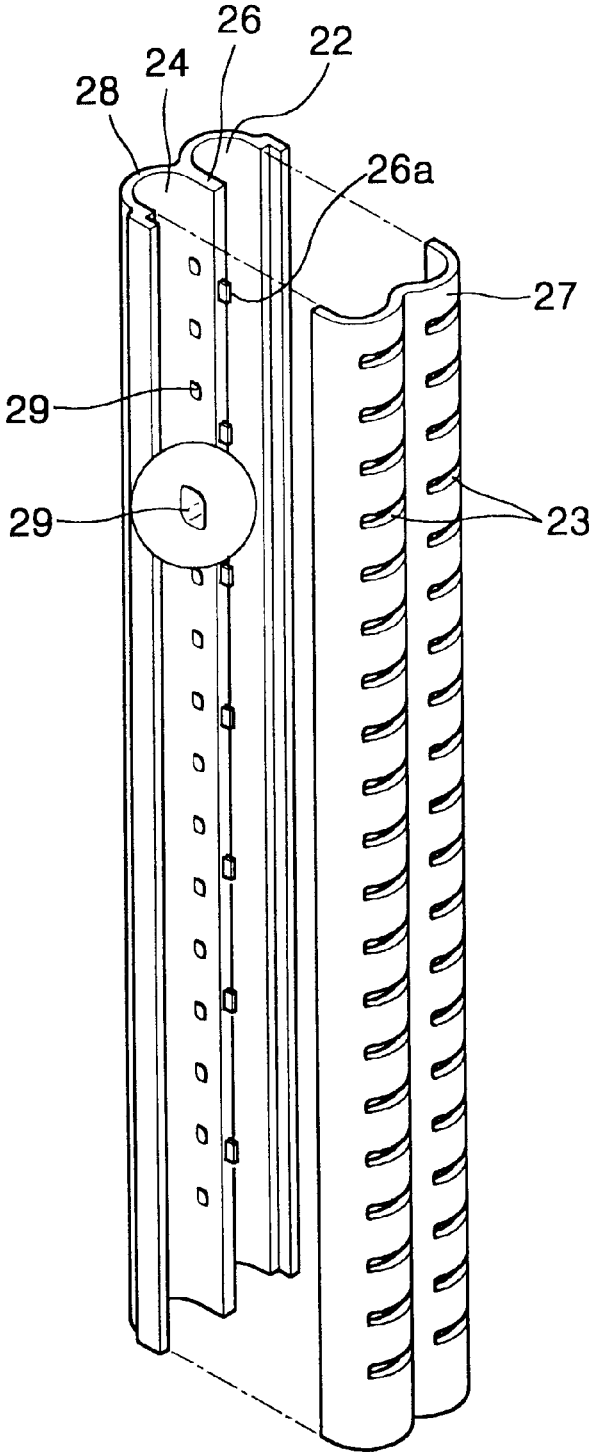
Figure 11:
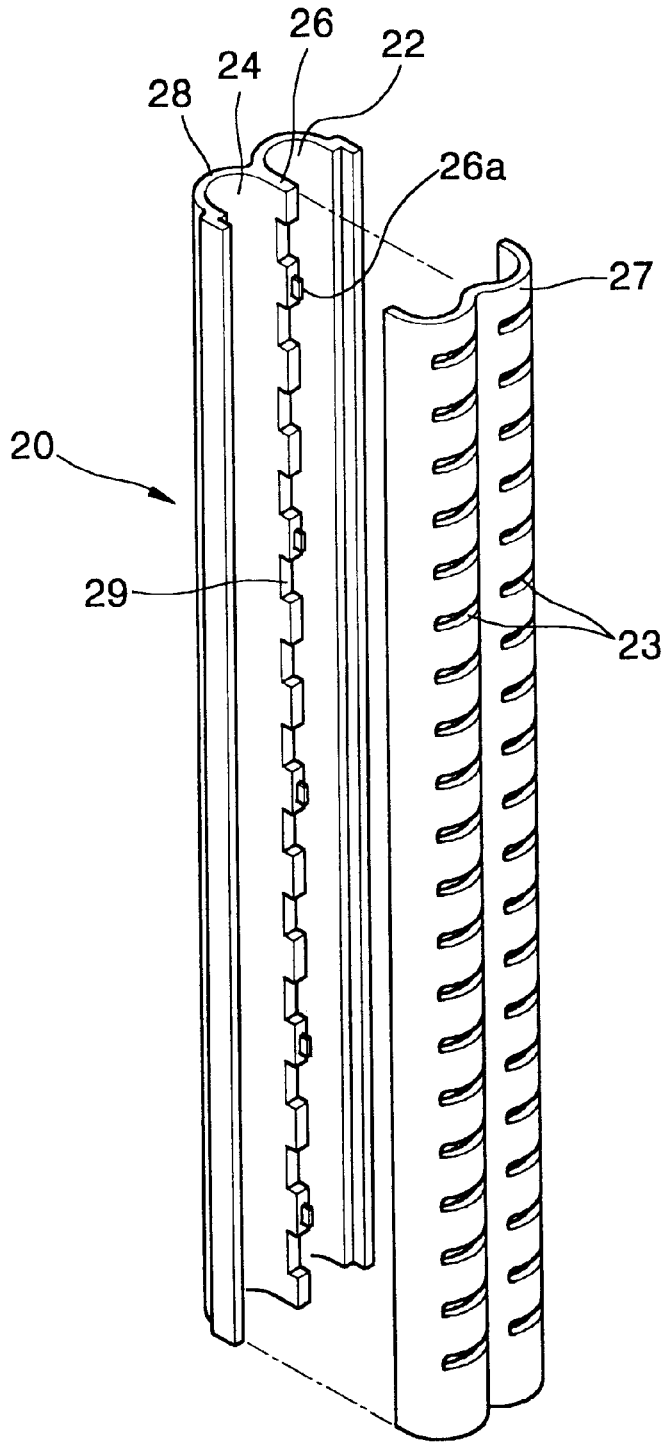

In the meantime, in the second header pipe 20, as shown in FIG. 7, a plurality of return holes 29 are formed to connect the independent chambers 22 and 24. The return holes 29 according to a preferred embodiment of the present invention, as shown in FIG. 8, can be formed by punching the partition wall 26 which is integrally formed in the tank 28 of the second header pipe 20. The return holes 29 are formed to be almost circular, as shown in FIG. 7, rectangular with round apexes, as shown in FIG. 9, or square, as shown in FIG. 10. The return holes 29, as shown in FIG. 11, can be formed by forming a plurality of rectangular grooves in the partition wall 26 of the tank 28 sectioning the independent chambers 22 and 24 of the second header pipe 20 and then coupling the tank 28 to the header 27. It is obvious that the return holes 29 may have any shapes which can connect the chambers 22 and 24.

It is obvious that the caulking coupling portion can be formed at the second header pipe 20 where the return holes 29 are formed. The size of each return hole can vary within a range in which the return holes can endure the pressure of the carbon dioxide refrigerant and simultaneously the connection through the return holes can be smoothly performed.

Figure 12:
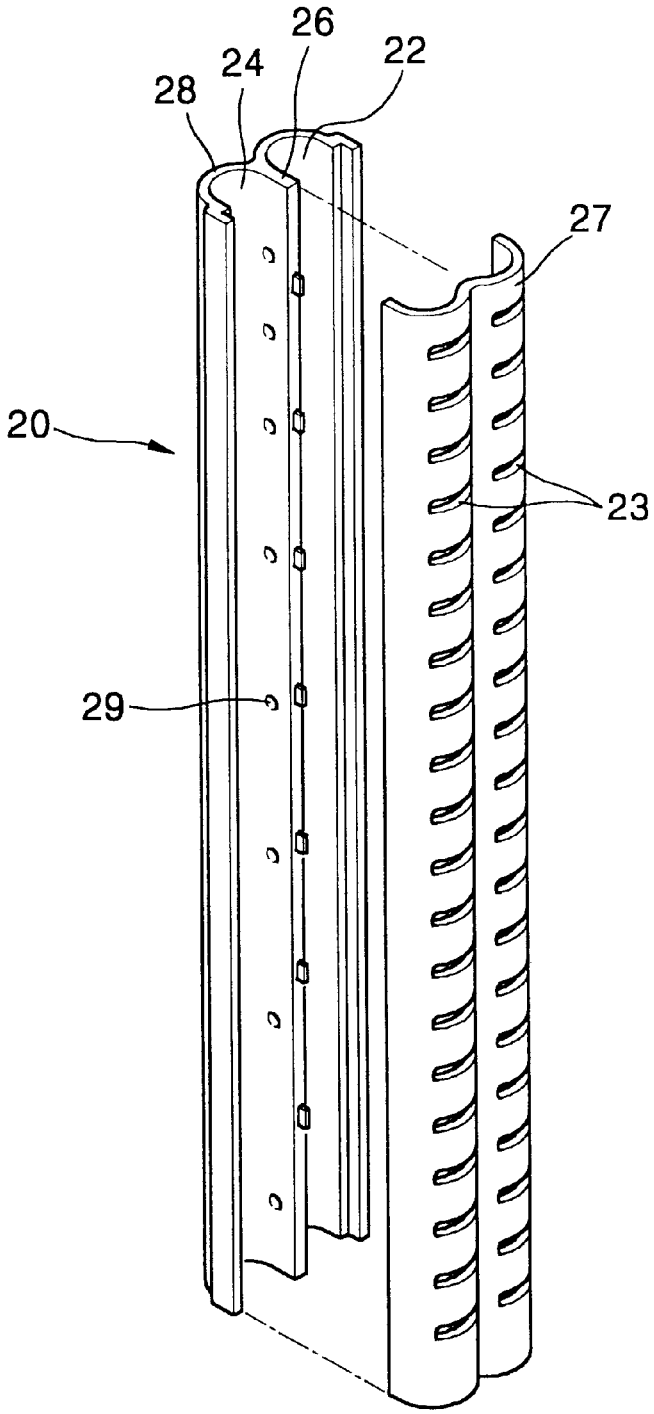

The return holes 29, as shown in FIG. 12, can be formed to be relatively closer to each other at the upper portion where the refrigerant inlet pipe is installed and to be relatively far from each other at the lower portion where the refrigerant outlet pipe is installed. That is, the interval between the return holes 29 decreases toward the upper portion of the second header pipe 20 and increases toward the lower portion of the second header pipe 20. In the case of the carbon dioxide refrigerant, since the density thereof sharply increases non-linearly as the temperature is lowed from a material close to gas state to a material close to liquid state, so that a specific gravity thereof increases, the carbon dioxide refrigerant is concentrated on the lower portion of the second header pipe 20. Thus, the return holes 29 are densely formed at the upper portion of the second header pipe 20 where the refrigerant inlet pipe is installed so that the connection of the refrigerant between the chambers 22 and 24 in the second header pipe 20 can be distributed uniformly throughout the entire length of the second header pipe 20. When the refrigerant is smoothly distributed, since the refrigerant is uniformly distributed throughout the entire heat exchanger, the performance of the heat exchanger can be improved.

Figure 13:
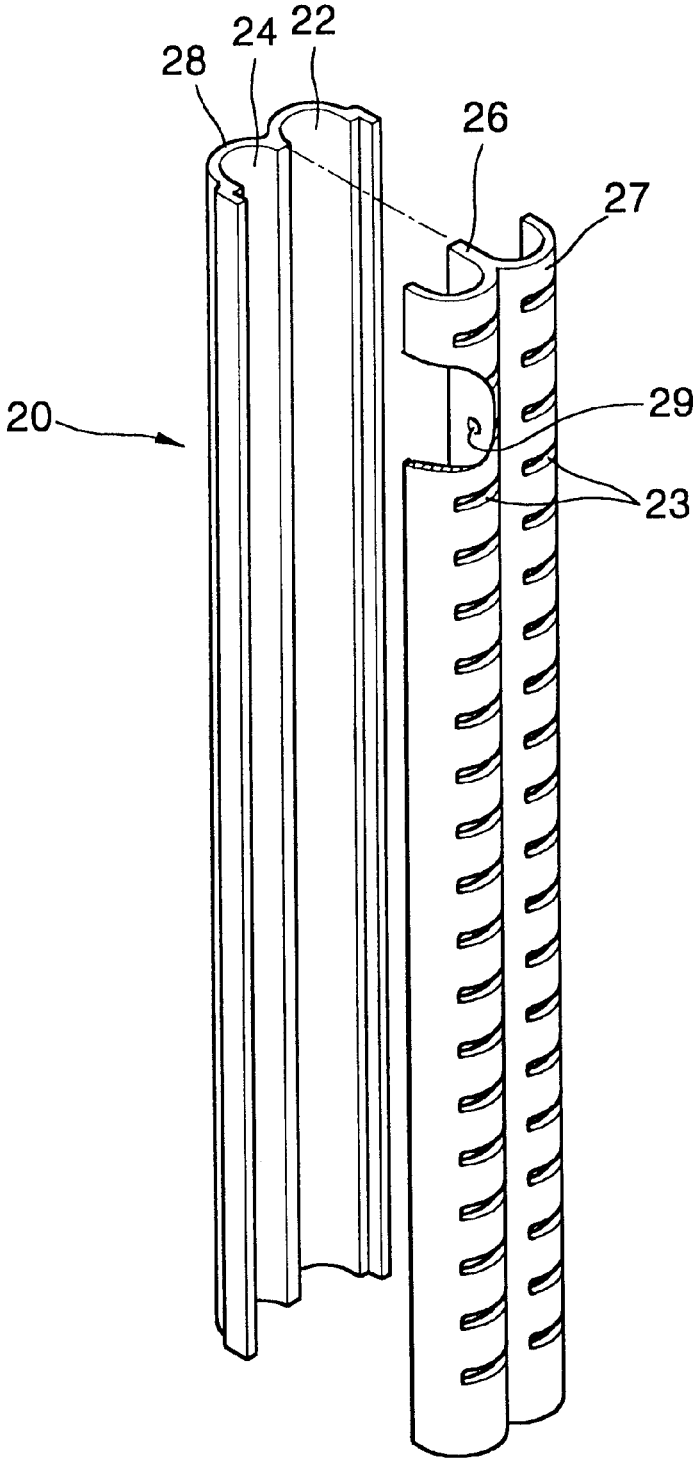
FIGS. 13 and 14 are exploded perspective views illustrating different preferred embodiments of the second header pipe according to the present invention.
Figure 14:
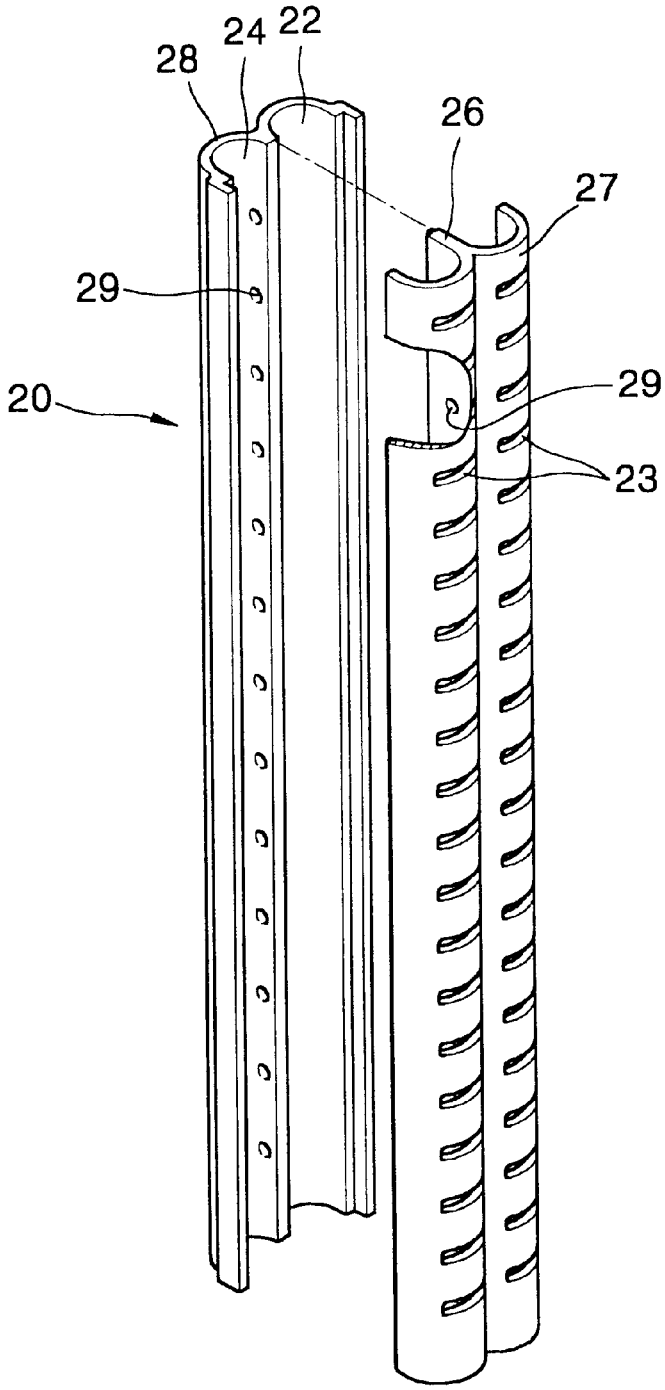

The return holes 29, as shown in FIGS. 12 through 14, can be formed in the partition wall 26 of either the header 27 or the tank 28, or in the partition wall 26 formed in both of the header 27 and the tank 28. That is, when the partition wall 26 is formed at the tank 28, as shown in FIG. 12, the return holes 29 are formed in the partition wall 26 formed in the tank 28. When the partition wall 26 is formed at the header 27, as shown in FIG. 13, the return holes 29 are formed in the partition wall 26 formed in the header 27. When the partition wall 26 is formed at each of both the header 27 and the tank 28, as shown in FIG. 14, the return holes 29 are formed in the partition walls 26 formed in both the header 27 and the tank 28.

When the return holes 29 are formed in the partition wall 26 as above, since the header 27 and the tank 28 completely contact each other in the second header pipe 20 and a partially non-contact portion due to the return holes 29 is not generated, a coupling force between the header 27 and the tank 28 can be further improved.

As shown in FIGS. 13 and 14, the partition wall 26 of the header 27 where the return holes 29 are formed cannot be formed by press-processing the header 27. in this case, the return holes 29 and the partition wall 26 can be simultaneously formed by an extrusion process.

As described above, the structures of the first header pipe 10 and the second header pipe 20 can be applied to the heat exchangers according to all of the above-described preferred embodiments of the present invention regardless of the number of the chamber.

In the meantime, the structure of the tube 50 adopted in the heat exchanger according to the present invention will now be described. The structure of the tube 50 can be applied to all of the preferred embodiments of the present invention which are described above and below.

First, the heat exchanger can be miniaturized by using a feature of the carbon dioxide refrigerant whose specific volume is sharply lowered as the temperature decreases.

Figure 15:
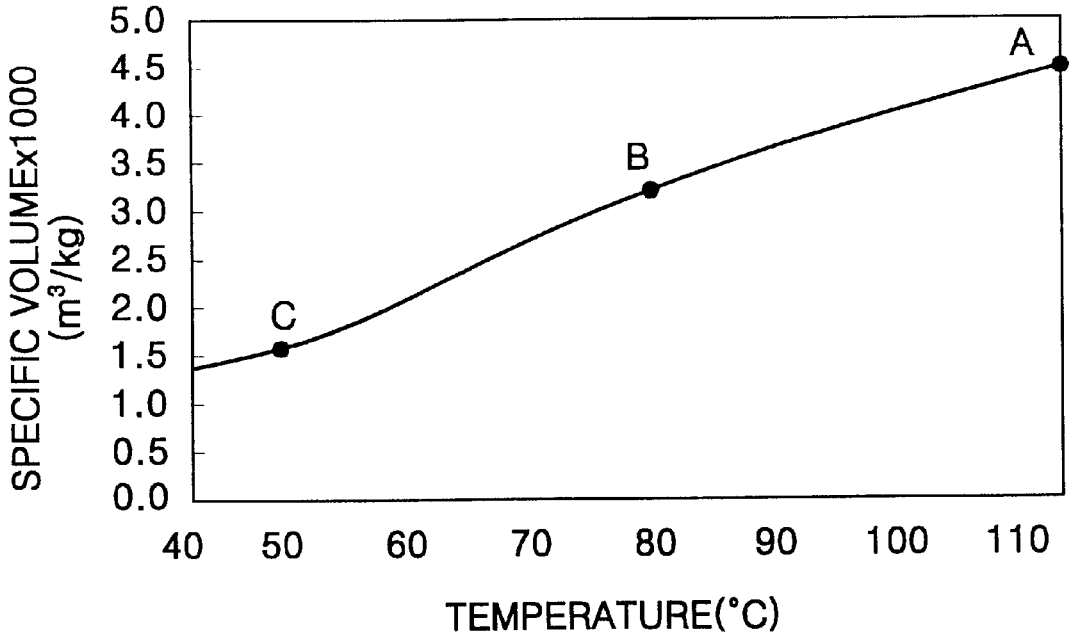
FIG. 15 is a graph showing a change in specific volume according to the temperature of a refrigerant in the heat exchanger of FIG. 16.

As described above, the operational pressure ranges between 100 through 130 bar when the heat exchanger using carbon dioxide as a refrigerant is used as a gas cooler functioning as a condenser. Here, the specific volume of the refrigerant in the heat exchanger decreases as the temperature is reduced by the heat exchange, as shown in FIG. 15. That is, a point A indicates the temperature and the specific volume when the refrigerant is supplied through the refrigerant inlet pipe of the heat exchanger and a point C indicates the temperature and the specific volume when the refrigerant is exhausted through the refrigerant outlet pipe of the heat exchanger after the heat transfer is completed. Thus, the refrigerant coming in at a temperature of 110° C. is exhausted at a temperature of about 50° C. Here, the specific volume of the refrigerant is reduced to about ⅓.

Figure 16:
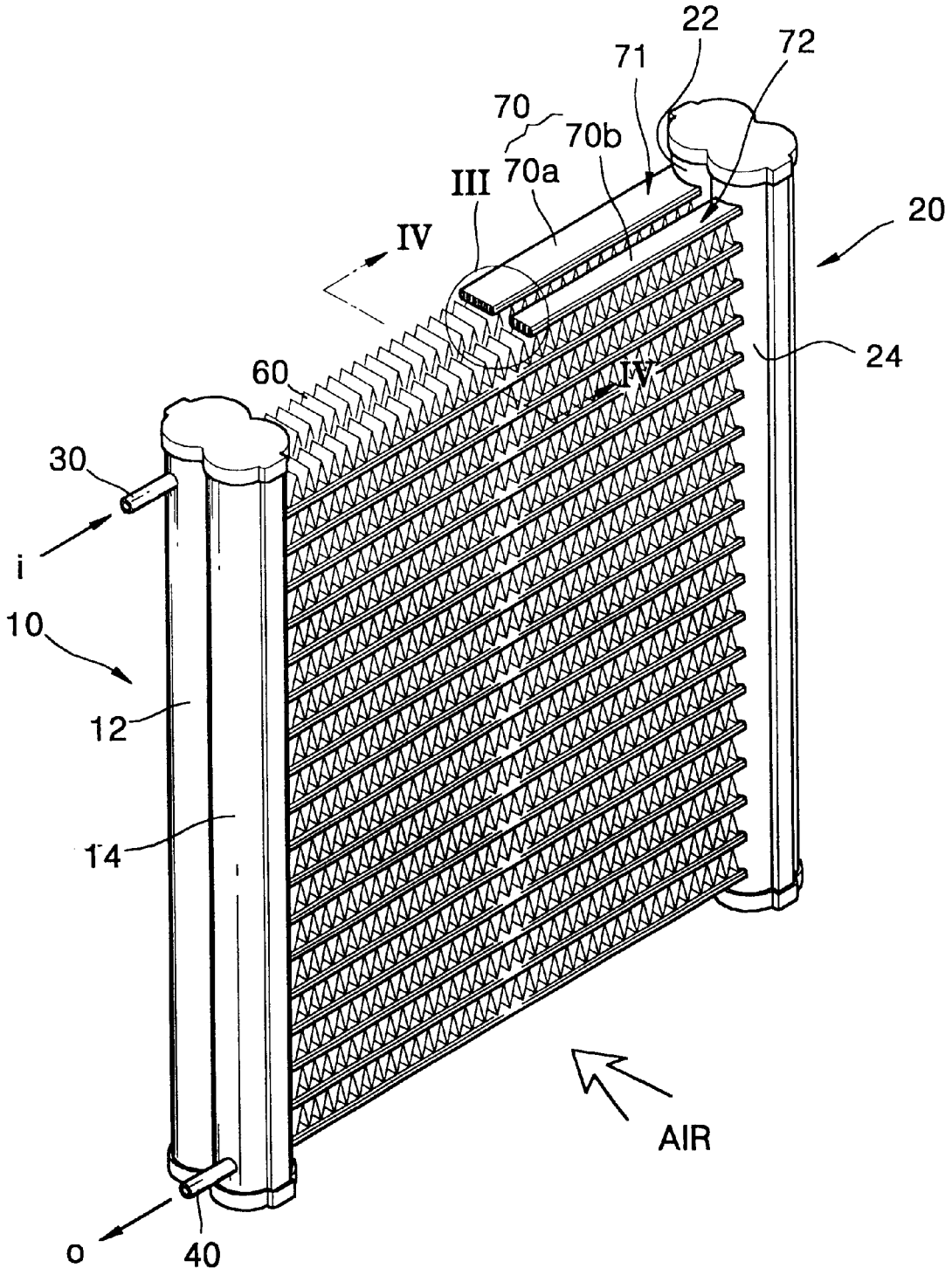
FIG. 16 is a perspective view illustrating a heat exchanger according to a still yet another preferred embodiment of the present invention.

FIG. 16 shows a heat exchanger according to another preferred embodiment of the present invention which is made compact by using the feature of carbon dioxide refrigerant whose specific volume is remarkably reduced as the temperature is reduced.

Referring to the drawing, the heat exchanger according to the present preferred embodiment of the present invention has the same structure as the above-described heat exchangers, except for the structure of a tube 70. Here, the following description concentrates on the tube 70 since the other elements are the same as those of the heat exchangers according to the above-described preferred embodiments. The heat exchanger shown in FIG. 16 includes the first and second header pipes 10 and 20 each having two chambers 12 and 14, and 22 and 24, respectively. However, the present preferred embodiment is not limited to the above structure and the structure shown in FIG. 2 can be adopted. Also, the structure of the tube rows according to the present preferred embodiment can be adopted in the above-described preferred embodiments in which at least one baffle is provided at the chamber of the header pipe.

In the heat exchanger as shown in FIG. 16, the refrigerant performs a first heat transfer while passing through the first tube group 71 and a second heat transfer while passing through the second tube group 72. Thus, the temperature of the refrigerant flowing through the first tube group 71 performing the first heat transfer and the temperature of the refrigerant flowing through the second tube group 72 performing the second heat transfer are different from each other. When the heat exchanger is used as a gas cooler, the temperature of the refrigerant of the first tube group 17 is higher than that of the refrigerant of the second tube group 72.

That is, as can be seen from FIGS. 15 and 16, the refrigerant coming in the state of the point A becomes a state of the point B after completing the first heat and then becomes a state of the point C after completing the second heat. Although a difference in specific volume between the incoming point and the outgoing point of the refrigerant is such that the final specific volume is about 30% of the initial specific volume, it can be seen that the specific volume at the point B that is a middle return point is 65% of the initial specific volume. Thus, the width of the tubes performing heat transfer from the point A to the point B can be different from the width of the tubes performing heat transfer from the point B to the point C. The width of tubes **70*b* of the second tube group 72 where the second heat transfer is performed from the point B to the point C through which the refrigerant at a low temperature flows can be formed less than the width of tubes 70*a* of the first tube group 71** where the first heat is performed from the point A to the point B through which the refrigerant at a high temperature flows. Hereunder, a difference in width of the tubes will now be described in detail.

Figure 17:
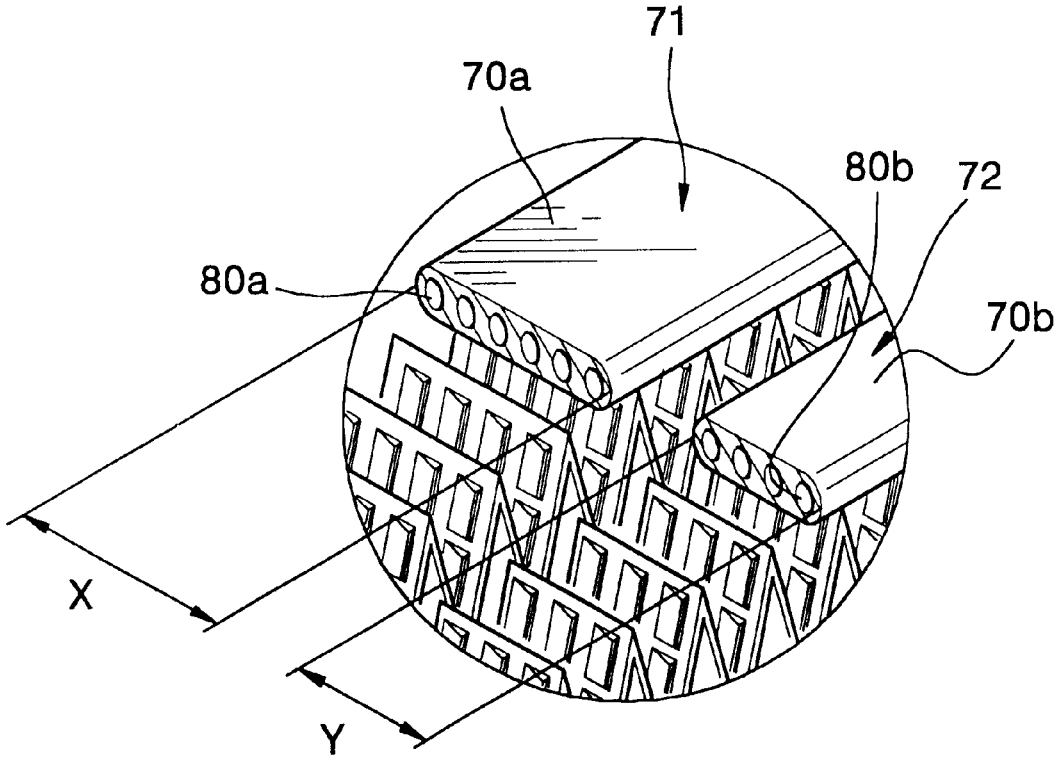
FIG. 17 is an enlarged view illustrating a portion III of FIG. 16.

FIG. 17 is an enlarged view of a portion III of FIG. 16. Referring to FIG. 17, when the width of the tubes **70*a* constituting the first tube group 71 is X and the width of the tubes 70*b* constituting the second tube group 72 is Y, X is greater than Y. Here, it is preferable that a difference in width of the tubes of the first tube group 71 and the second tube group 72** is not too great. This is because an excessive decrease in width of the tube causes an excessive pressure drop in the refrigerant so that cooling performance is deteriorated.

Figure 19:
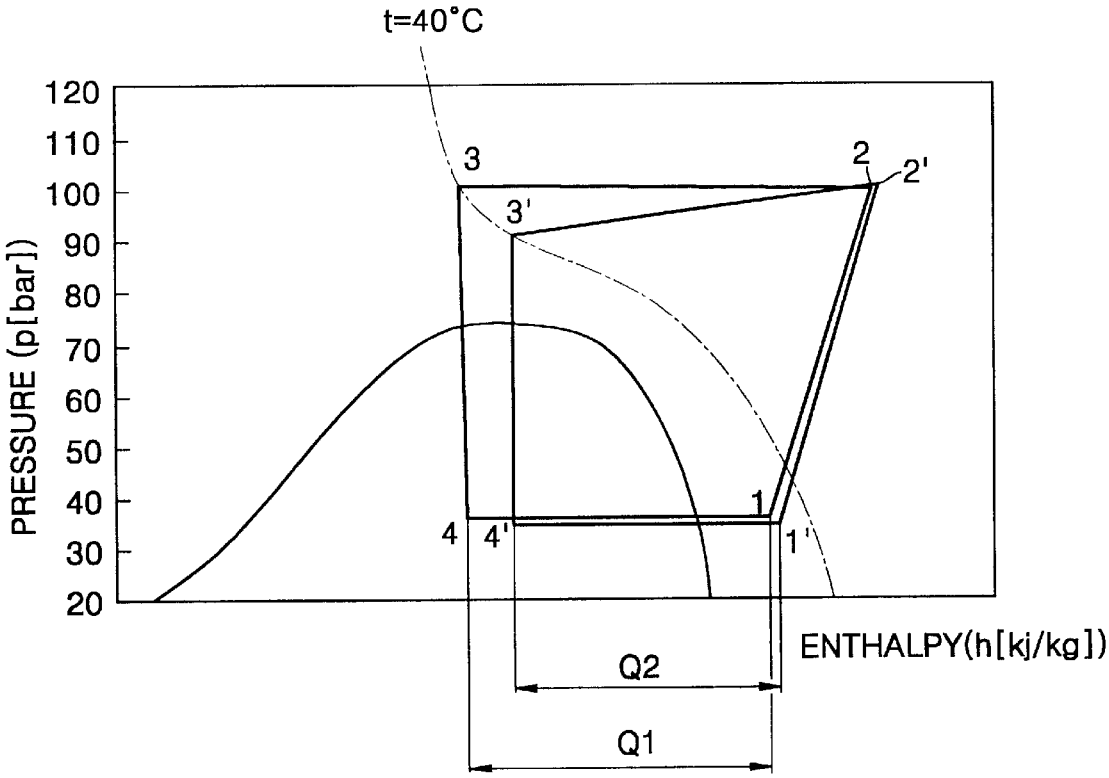
FIG. 19 is a p-h graph of a cooling cycle of a carbon dioxide refrigerant in the hear exchanger of FIG. 16.

That is, in a p-h curve of the carbon dioxide refrigerant shown in FIG. 19, a gas cooling in the heat transfer when the refrigerant does not generate a pressure drop indicates a period of 2→3 and the amount of heat absorbed by an evaporator accordingly indicates Q1 of a period of 4→1. However, when the refrigerant causes a pressure drop between the inlet and outlet pipes, a start pressure in gas cooling slightly increases, so that the gas cooling begins from a point 2' and is performed in a period of 2'→3'. As a vaporization pressure is slightly lowered and a degree of overheat is slightly raised so that a vaporization curve forms a period of 4'→1'. Here, the amount of heat absorbed by the evaporator is Q2 less than Q1 so that the cooling performance is lowered.

Accordingly, in the heat exchanger shown in FIG. 16 according to a preferred embodiment of the present invention, the width X of the tubes 70*a* constituting the first tube group 71 and the width Y of the tubes 70*b* constituting the second tube group 72 preferably satisfy a relationship that $0.5X \leqq Y < X$. That is, the width of the tubes 70*b* of the second tube group 72 through which the refrigerant at a lower temperature is formed to be less than that of the width of the tubes 70*a* of the first tube group 71 and at least equal to or greater than the half of the width of the tubes 70*a*.

Figure 18A:
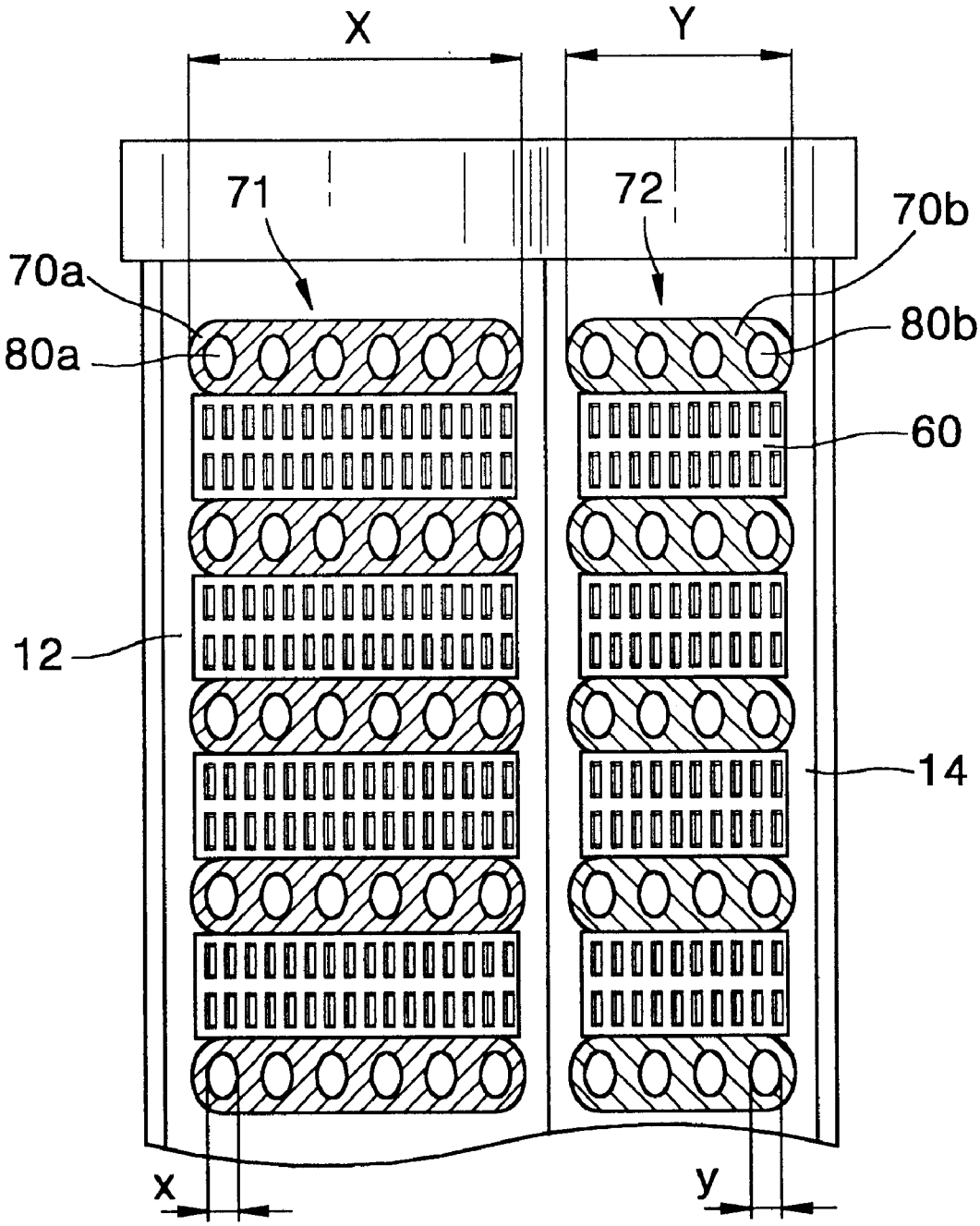
FIGS. 18A and 18B are sectional views, taken along line IV—IV of FIG. 16, illustrating preferred embodiments in which tubes are differently arranged.

The above relationship is not limited to the width of the tubes and can be expressed by a hydraulic diameter of tube holes through which the refrigerant actually passes in the tubes. That is, as can be seen from FIGS. 18A and 18B, when the inside of the tube of the present invention is formed of a plurality of micro channel tubes through which the refrigerant flows, as shown in FIG. 18A, when the hydraulic diameter of micro channel tube 80*a* of the tubes 70*a* of the first tube group 71 is x and the hydraulic diameter of a micro channel tube 80*b* of the tubes 70*b* of the second tube group 72 is y, they preferably satisfy a relationship that $0.5\Sigma x \leqq \Sigma y < \Sigma x$. The sum of the hydraulic diameter of each tube is a space through which the refrigerant actually passes.

Figure 18B:
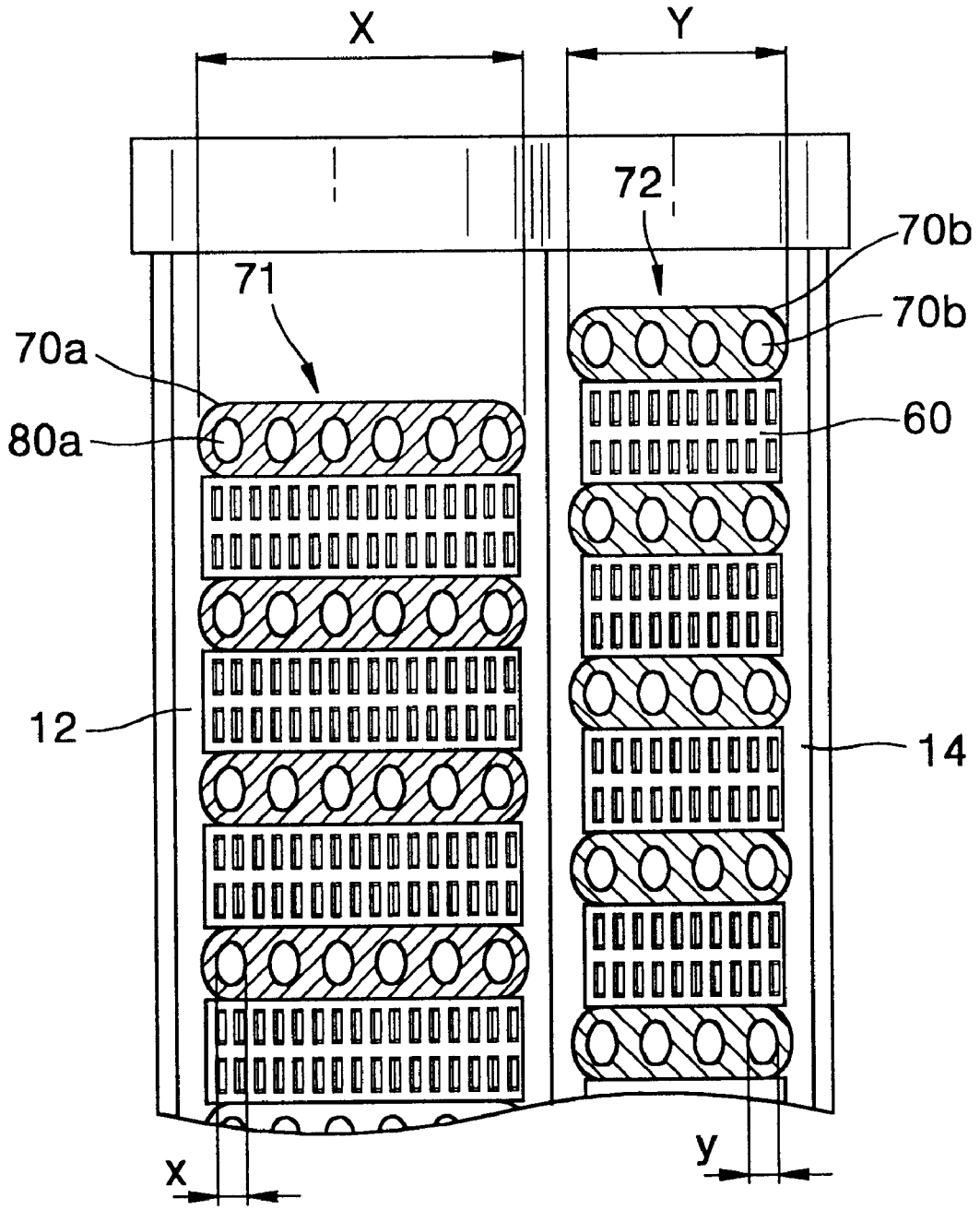

Also, as shown in FIG. 18B, the tubes 70*a* of the first tube group 71 and the tubes 70*b* of the second tube group 72 are arranged to be zigzag. When the tubes are arranged to be zigzag, vortex is generated in the flow of air passing between the tubes so that an efficiency of heat transfer is improved.

As described above, since the specific volume when the refrigerant performs the second heat transfer is less than that when the first heat transfer is performed, the efficiency of heat transfer can be equally maintained even when the tubes having a smaller width are provided.

Figure 20A:
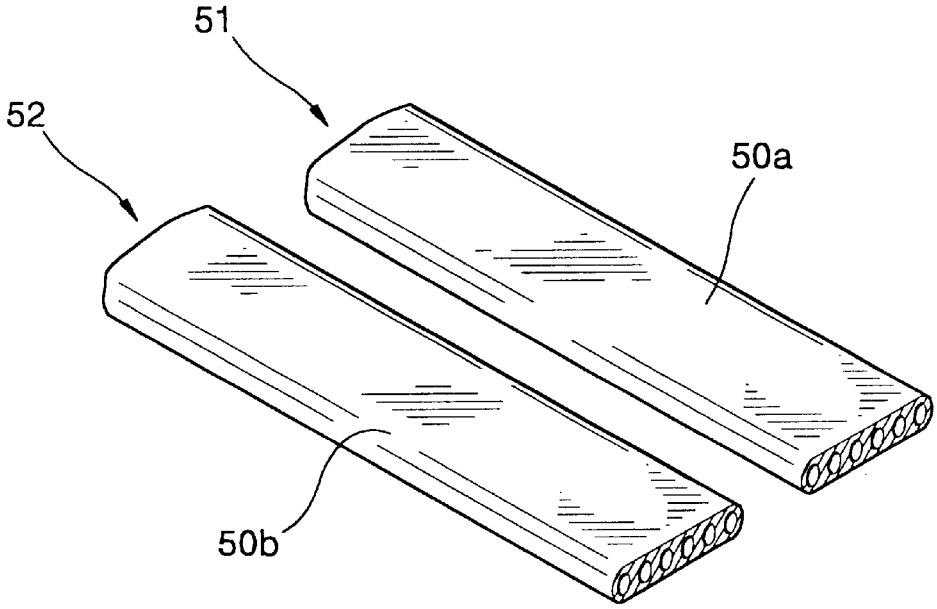
FIGS. 20A and 20B are perspective views illustrating different preferred embodiments of tubes of the heat exchanger according to the present invention.
Figure 20B:
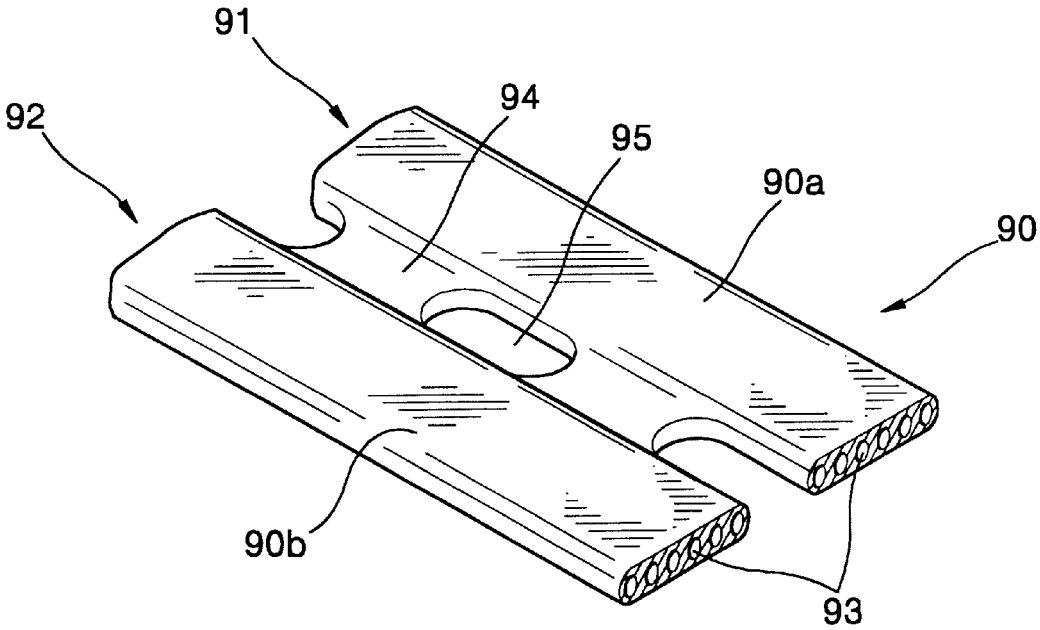

In the meantime, as shown in FIG. 1, the rows of tubes 50 connecting the independent chambers are divided into the first tube group 51 and the second tube group 52. The tubes 50*a* constituting the first tube group 51 and the tubes 50*b* constituting the second tube group 52 are separately formed without any connection member therebetween, as a separate type tube, as shown in FIG. 20A, or integrally formed as an integral type tube, as shown in FIG. 20B. Referring to FIG. 20B, a integral type tube 90 includes a tube 90*a* of a first tube groove 91 and a tube 90*b* of a second tube group 92 which are connected by a bridge 94 formed therebetween. The tube 90*a* and the tube 90*b* which are connected each other by the bridge can be formed integrally in a manufacturing step. A through-hole 95 is formed between the adjacent bridges 94 to prevent heat exchange between the tubes 90*a* and 90*b*. Since the integral type tube 90 is integrally formed with the tubes to be inserted in each header pipe, an assembling step is made easy.

A plurality of micro channel tubes 93 are formed in each of the tubes 90*a* and 90*b* so that the efficiency of heat transfer of a refrigerant flowing in the tubes, in particular, the carbon dioxide refrigerant, is improved.

Next, a method of manufacturing the integral type tube 70 as shown in FIG. 20B, will now be described.

Figure 21A:
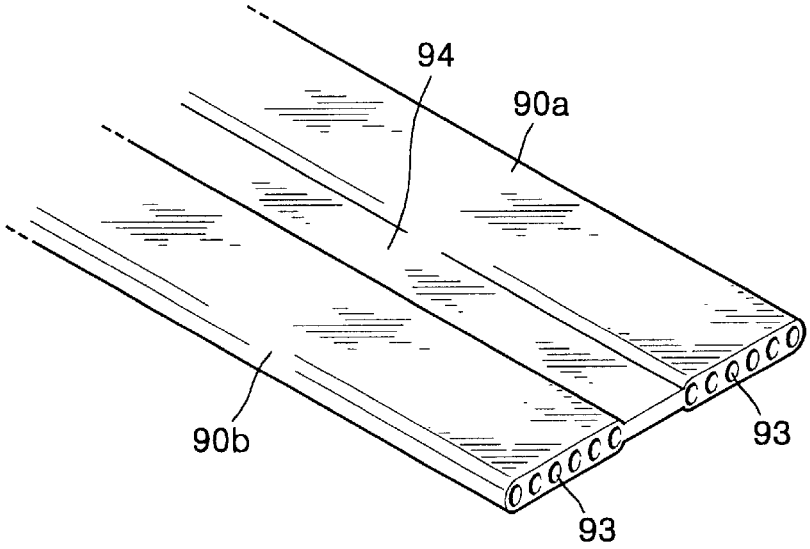
FIGS. 21A through 21D are views for explaining a method of manufacturing the tubes of FIG. 20B.

First, as shown in FIG. 21A, the first tube 90*a* and the second tube 90*b*, having a plurality of micro channel tubes 93 through which the refrigerant flows, and the bridge 94 connecting the first and second tubes 90*a* and 90*b* are integrally formed by an extrusion process. Here, the bridge 94 is preferably formed to be thinner than the first and second tubes 90*a* and 90*b* to reduce heat transfer between the first and second tubes 90*a* and 90*b*.

Figure 21B:
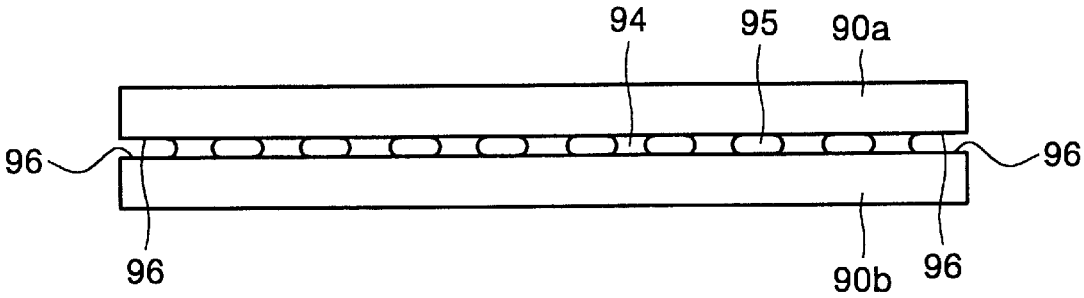

Through-holes 95 are formed by punching the bridge 94 at a predetermined interval, as shown in FIG. 21B, and the tube is cut by a desired length. The tube is cut such that both end portions thereof are disposed at the through-hole 95, and so the tube can be inserted in the header pipe.

Figure 21C:
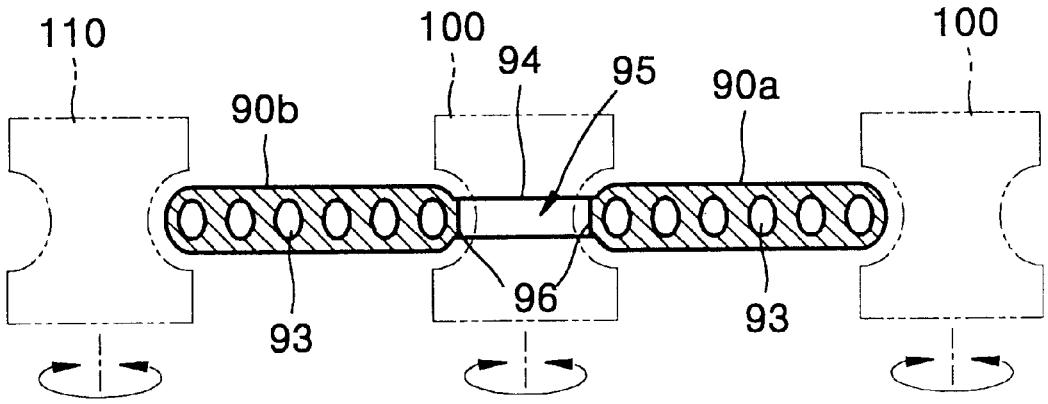
Figure 21D:
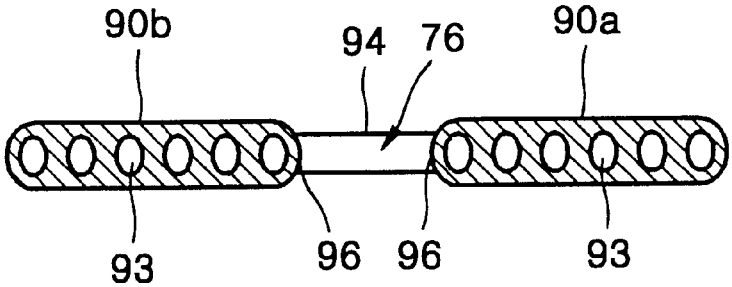

FIG. 21C shows an end portion of the cut tube. As shown in the drawing, both side surfaces of the through-hole 95 formed at the bridge 94 do not accurately match the side surfaces of the first and second tubes 90*a* and 90*b*. When the tubes are inserted in the tube slot of the header pipe in this state, the header pipes can be scratched during insertion, which causes failure of brazing. Thus, a step of making both end portions of the tube to be smooth by a post process is needed. When the shape of the slot is oval, the end portion of the tube should be rounded by rounding apparatus 100 and 110, as shown in FIG. 21C. In particular, the end portion 96 of the tube should be made smooth by the rounding process, as shown in FIG. 21D.

The above description is based on the tube installed at a heat exchanger having two additional tube rows performing heat transfer. However, the tube can be equally applied to a multi-slab type heat exchanger having a plurality of tube rows.

As described above, the following effects can be obtained by the present invention.

First, as the carbon dioxide refrigerant flows through the tubes of the heat exchanger, a self-heat transfer is generated so that the reduction of the efficiency of heat transfer with the outside air can be prevented.

Second, a superior pressure resistance feature can be obtained with respect to a refrigerant acting at a high pressure such as carbon dioxide. Also, the refrigerant is uniformly distributed throughout the entire heat exchanger, so that the performance of the heat exchanger can be considerably improve.

Third, by forming the return holes in the header pipe, the carbon dioxide refrigerant is smoothly connected or the refrigerant is uniformly distributed in a multi-slab type heat exchanger.

Fourth, the structure of the header pipe adopted in the heat exchanger according to the present invention can be applied to not only a multi-slab type heat exchanger but also a multi-pass type heat exchanger. Thus, the longitudinal and latitudinal lengths of the entire heat exchanger can be reduced while the width thereof is enlarged so that the header pipe of the present invention can be used for an evaporator for carbon dioxide and simultaneously used as a gas cooler and an evaporator in a heat pump for carbon dioxide.

Fifth, the structure of the heat exchanger according to the present invention can be applied to a heat exchanger using different refrigerant other than carbon dioxide as well as the heat exchanger using the carbon dioxide refrigerant.

Sixth, in using a refrigerant, such as carbon dioxide, whose specific volume sharply changes according to the temperature, the entire weight and volume of the heat exchanger can be remarkably reduced without lowering cooling performance too much.

Seventh, in the heat exchanger for carbon dioxide, the tubes can be assembled in a single process and easily manufactured with the existing equipment, thus improving productivity.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A heat exchanger, comprising:

first and second header pipes arranged at a predetermined distance from each other and parallel to each other, each of said first and second header pipes having at least two chambers independently separated by a partition wall;

a plurality of tubes separately connecting the chambers of the first and second header pipes that face each other, wherein the tubes are divided into at least two tube groups each having a single refrigerant path;

a refrigerant inlet pipe which is formed at the chamber disposed at one end portion of the first header pipe, and through which a refrigerant is supplied;

a plurality of return holes which are formed in the partition wall to connect two chambers adjacent to each other, and through which the refrigerant sequentially flows through the tube groups; and a refrigerant outlet pipe which is formed at the chamber of one of the first and second header pipes that is connected to a final tube group of the tube groups along the flow of the refrigerant, and through which the refrigerant is exhausted.

2. The heat exchanger as claimed in claim 1, wherein the refrigerant paths of the tube groups adjacent to each other among the tube groups are opposite to each other.

3. The heat exchanger as claimed in claim 1, wherein the tube group connected to the chamber where the refrigerant output pipe is formed is arranged at an upstream of the flow of air supplied into the heat exchanger.

4. The heat exchanger as claimed in claim 1, wherein the tube group is formed of a row of the tubes connecting one of the chambers of the first header pipe and one of the chambers of the second header pipe corresponding thereto.

5. The heat exchanger as claimed in claim 1, wherein at least a baffle for sectioning each chamber is provided at each of at least two chambers of each of the first and second header pipes.

6. The heat exchanger as claimed in claim 5, wherein the refrigerant inlet pipe and the refrigerant outlet pipe are formed in the same chamber.

7. The heat exchanger as claimed in claim 5, wherein the refrigerant inlet pipe and the refrigerant outlet pipe are formed in different chambers of the first header pipe.

8. The heat exchanger as claimed in claim 1, wherein the chambers of the first and second header pipes are roughly circular.

9. The heat exchanger as claimed in claim 1, wherein a thickness of a horizontal section of the partition wall is thicker than a thickness of a horizontal section of the remaining portion of the first and second header pipes.

10. The heat exchanger as claimed in claim 9, wherein a thickness of a horizontal section of the partition wall is 1.5 through 2.5 times greater than a thickness of a horizontal section of the other portion.

11. The heat exchanger as claimed in claim 1, wherein each of the return holes is roughly circular.

12. The heat exchanger as claimed in claim 1, wherein each of the return holes is roughly rectangular.

13. The heat exchanger as claimed in claim 1, wherein the return holes are arranged in a lengthwise direction of the header pipe.

14. The heat exchanger as claimed in claim 1, wherein each of the first and second header pipes is formed by brazing a header which is extruded or press-processed and has a plurality of slits into which the tubes are inserted and a tank which is extruded or press-processed.

15. The heat exchanger as claimed in claim 14, wherein the partition wall is integrally formed at at least one of the header and the tank of each of the first and second header pipes.

16. The heat exchanger as claimed in claim 14, wherein the first and second header pipes comprise at least one caulking coupling portion.

17. The heat exchanger as claimed in claim 16, wherein the caulking coupling portion is provided between at least one of the header and the tank and the partition wall.

18. The heat exchanger as claimed in claim 1, wherein the partition wall is formed of additional member and brazed to an inner wall of each of the first and second header pipes.

19. The heat exchanger as claimed in claim 1, wherein thicknesses of the tubes are formed different from one tube group to the other tube group, according to a temperature of the refrigerant flowing through each tube group.

20. The heat exchanger as claimed in claim 19, wherein the width of each tube of the tube group through which a refrigerant of a high temperature flows is formed to be greater than the width of tube of the tube group through which a refrigerant of a low temperature flows.

21. The heat exchanger as claimed in claim 20, wherein, when a width of each tube of the tube group through which a refrigerant of a high temperature flows is X and a width of each tube of the tube group through which a refrigerant of a low temperature flows is Y, the X and Y satisfy a relationship that $0.5X \leqq Y < X$.

22. The heat exchanger as claimed in claim 20, wherein each of the tubes comprises a plurality of micro channel tubes, and when a hydraulic diameter of each micro channel tube of the tube group through which a refrigerant of high temperature flows is x and a hydraulic diameter of each micro channel tube of the tube group through which a refrigerant of low temperature flows is y, the x and y satisfy a relationship that $0.5\Sigma x \leqq y < \Sigma x$.

23. A heat exchangers comprising:

first and second header pipes arranged to be separated a predetermined distance from each other and parallel to each other;

a plurality of tubes connecting the first and second header pipes;

a refrigerant inlet pipe which is formed at one end portion of the first header pipe and through which a refrigerant is supplied to the first header pipe; and a refrigerant outlet pipe which is formed at one of the first and second header pipes and through which the refrigerant is exhausted;

wherein the tubes neighboring with each other are connected by a bridge in which a plurality of through holes are formed.

24. The heat exchanger as claimed in claim 23, wherein the bridge is formed to be thinner than the tubes.

25. The heat exchanger as claimed in claim 23, wherein each of the first and second header pipes has at least two chambers separated by a partition wall, and the tubes separately connect the chambers of the first and second header pipes that face each other.

26. The heat exchanger as claimed in claim 25, wherein each of the chambers is divided into at least two spaces extending along a lengthwise direction of the respective header pipe, and the respective tubes are connected to the spaces of each chamber.

* * * * *